US007914004B2

(12) United States Patent
Wright et al.

(10) Patent No.: US 7,914,004 B2
(45) Date of Patent: Mar. 29, 2011

(54) METHOD FOR USING A MULTIFUNCTION TARGET ACTUATOR

(75) Inventors: Thomas Wright, Highland, UT (US); Thomas Marshall, Lakeshore, UT (US); Kyle Bateman, Provo, UT (US)

(73) Assignee: Action Target Inc., Provo, UT (US)

( * ) Notice: Subject to any disclaimer, the term of this patent is extended or adjusted under 35 U.S.C. 154(b) by 0 days.

(21) Appl. No.: 12/561,028

(22) Filed: Sep. 16, 2009

(65) Prior Publication Data

US 2010/0013162 A1 Jan. 21, 2010

Related U.S. Application Data

(62) Division of application No. 11/506,413, filed on Aug. 17, 2006.

(60) Provisional application No. 60/709,992, filed on Aug. 19, 2005.

(51) Int. Cl.
*F41J 7/00* (2006.01)
*F41J 7/06* (2006.01)

(52) U.S. Cl. ..... 273/406; 273/391

(58) Field of Classification Search ..... 273/403–410, 273/359, 366–370, 390–392; 91/167 R, 91/168, 167 A See application file for complete search history.

(56) References Cited

U.S. PATENT DOCUMENTS

| | | | |
|---|---|---|---|
| 429,942 | A | 6/1890 | McBride |
| 631,175 | A | 8/1899 | Parnall |
| 840,610 | A | 1/1907 | Easdale |
| 879,670 | A | 2/1908 | Petry |
| 950,101 | A | 2/1910 | Green |
| 960,085 | A | 5/1910 | Giles |
| 1,207,456 | A | 12/1916 | Whelan |
| 1,348,283 | A | 8/1920 | Koehl |
| 1,424,632 | A | 8/1922 | Fenton |
| 1,543,605 | A | 6/1925 | Gavard |
| 1,559,171 | A | 10/1925 | Knowles |
| 1,657,931 | A | 7/1926 | Krantz |
| 1,640,954 | A | 8/1927 | Mach |
| 1,738,874 | A | 12/1929 | Domingo |
| 1,831,289 | A | 11/1931 | Dally |
| 2,048,155 | A | 1/1935 | Armantrout |
| 2,008,359 | A | 7/1935 | Lamb |
| 2,039,552 | A | 5/1936 | Reynolds |
| 2,085,933 | A | 7/1937 | Vaughan |
| 2,104,171 | A | 1/1938 | Schwerin |
| 2,179,471 | A | 11/1939 | Lee |
| 2,284,510 | A | 5/1942 | Cates |

(Continued)

FOREIGN PATENT DOCUMENTS

| | | |
|---|---|---|
| CA | 2100631 | 2/1994 |
| GB | 2136932 | 9/1984 |
| GB | 2 187 270 | 9/1987 |

OTHER PUBLICATIONS

Caswell International Corp., Product Literature, Copyright 2002.

(Continued)

*Primary Examiner* — Mark S Graham
(74) *Attorney, Agent, or Firm* — Bateman IP Law Group

(57) ABSTRACT

A multifunction target actuator allows a bullet target to be selectively presented to a shooter such that a first side may be presented, a second side opposite the first side may be presented, and the target may be oriented so as not to be presented to the shooter. The actuator allows for quick and accurate movement of the target.

38 Claims, 16 Drawing Sheets

U.S. PATENT DOCUMENTS 2,372,111 A 3/1945 Norberg
2,538,118 A 6/1949 Miller
2,587,042 A 2/1952 Haiselup
2,613,934 A 10/1952 Tabler
2,706,634 A 4/1955 Van Valkenburg
2,819,903 A 1/1958 Saunders
2,905,469 A 9/1959 Taylor
3,014,725 A 12/1961 Lewis
3,032,808 A 5/1962 Fleming
3,064,976 A 11/1962 Kuhn
3,087,701 A 4/1963 Wallace
3,103,362 A 9/1963 Elofson
3,113,773 A 12/1963 Ripepe
3,348,843 A 10/1967 Stanley
3,385,405 A 5/1968 Cullen
3,392,980 A 7/1968 Ortega
3,422,538 A 1/1969 Panissidi
3,515,388 A 6/1970 Zachmeier
3,540,729 A 11/1970 Rahberger
3,601,353 A 8/1971 Dale
3,802,098 A 4/1974 Sampson et al.
3,914,879 A 10/1975 Taylor, III
3,992,007 A 11/1976 Seeman
4,076,247 A 2/1978 Kim et al.
4,084,299 A 4/1978 Noda
4,086,711 A 5/1978 Gammarino et al.
4,177,835 A 12/1979 Paley
4,205,847 A 6/1980 Steiger et al.
4,228,569 A 10/1980 Snyder
4,232,867 A 11/1980 Tate, Sr.
4,288,080 A 9/1981 Laporte et al.
4,294,452 A 10/1981 Schlotter et al.
4,340,370 A 7/1982 Marshall et al.
4,361,330 A 11/1982 Scharer
4,395,045 A 7/1983 Baer
4,440,399 A 4/1984 Smith
4,501,427 A 2/1985 Payne
4,506,416 A 3/1985 Ohminato et al.
4,540,182 A 9/1985 Clement
4,546,984 A 10/1985 Towle et al.
4,614,345 A 9/1986 Doughty
4,657,261 A 4/1987 Saunders
4,691,925 A 9/1987 Scholem
4,726,593 A 2/1988 Wade
4,739,996 A 4/1988 Vedder
4,743,032 A 5/1988 Summers et al.
4,807,888 A 2/1989 Pidde et al.
4,844,476 A 7/1989 Becker
4,898,391 A 2/1990 Kelly et al.
4,911,453 A 3/1990 Essex et al.
4,913,389 A 4/1990 McCracken
4,979,752 A 12/1990 Fosseen
5,054,723 A 10/1991 Arnold
5,145,133 A 9/1992 France
5,163,689 A 11/1992 Bateman
5,213,336 A 5/1993 Bateman
5,232,227 A 8/1993 Bateman
5,240,258 A 8/1993 Bateman
5,242,172 A 9/1993 Bateman
5,263,721 A 11/1993 Lowrance
5,277,432 A 1/1994 Bateman
5,316,479 A 5/1994 Wong et al.
5,324,043 A 6/1994 Estrella
5,346,226 A 9/1994 Block
5,350,180 A 9/1994 Acock
5,352,170 A 10/1994 Condo et al.
5,361,455 A 11/1994 Kiefer
5,400,692 A 3/1995 Bateman
5,433,451 A 7/1995 De Vries
5,535,662 A 7/1996 Bateman
5,598,996 A 2/1997 Rath
5,618,044 A 4/1997 Bateman
5,621,950 A 4/1997 White
5,636,995 A 6/1997 Sharpe, III et al.
5,641,288 A 6/1997 Zaenglein, Jr.
5,648,794 A 7/1997 Jelsma et al.
5,649,706 A 7/1997 Treat, Jr. et al.
5,676,378 A 10/1997 West
5,765,832 A 6/1998 Huff
5,802,460 A 9/1998 Parvulescu et al.
5,811,718 A 9/1998 Bateman
5,822,936 A 10/1998 Bateman
5,829,753 A 11/1998 Wiser
5,865,439 A 2/1999 Marcuson
5,906,552 A 5/1999 Padilla
5,907,930 A 6/1999 Ricco
5,934,678 A 8/1999 Theissen et al.
5,947,477 A 9/1999 Turnipseed
5,950,283 A 9/1999 Sato
5,951,016 A 9/1999 Bateman
5,963,624 A 10/1999 Pope
5,967,523 A 10/1999 Brownlee
5,988,645 A 11/1999 Downing
6,018,847 A 2/2000 Lu
6,109,614 A 8/2000 Ciarcia
6,223,029 B1 4/2001 Stenman et al.
6,230,214 B1 5/2001 Liukkonen et al.
6,283,756 B1 9/2001 Danckwerth et al.
6,289,213 B1 9/2001 Flint et al.
6,308,062 B1 10/2001 Chien et al.
6,311,980 B1 11/2001 Sovine et al.
6,322,444 B1 11/2001 Matsui et al.
6,325,376 B1 12/2001 Elliott et al.
6,328,651 B1 12/2001 Lebensfeld et al.
6,332,243 B1 12/2001 Kim
6,378,870 B1 4/2002 Sovine
6,398,215 B1 6/2002 Carroll
6,463,299 B1 10/2002 Macor
6,478,301 B1 11/2002 Witmeyer
6,484,990 B1 11/2002 Marshall
6,502,820 B2 1/2003 Slifko
6,533,280 B1 3/2003 Sovine et al.
6,543,778 B2 4/2003 Baker
6,575,753 B2 6/2003 Rosa et al.
6,588,759 B1 7/2003 Bateman
6,679,795 B2 1/2004 Ouimette et al.
6,718,596 B2 4/2004 Kohlstrand et al.
6,728,546 B1 4/2004 Peterson et al.
RE38,540 E 6/2004 Bateman
6,761,357 B2 7/2004 Witt
6,776,418 B1 8/2004 Sovine et al.
6,808,177 B2 10/2004 Dehart
6,808,178 B1 10/2004 Sovine
6,896,267 B1 5/2005 Le Anna
6,975,859 B1 12/2005 Lambert et al.
6,994,348 B2 2/2006 Lambert et al.
6,994,349 B2 2/2006 Lambert et al.
7,134,977 B2 11/2006 Campbell et al.
7,140,615 B1 11/2006 Sovine et al.
7,175,181 B1 2/2007 Bateman et al.
7,194,944 B2 3/2007 Lambert et al.
7,201,376 B2 4/2007 Kuosa
7,219,897 B2 5/2007 Sovine et al.
7,234,890 B1 6/2007 Marshall et al.
7,264,246 B2 9/2007 Sovine et al.
7,275,748 B2 10/2007 Lambert et al.
7,303,192 B2 12/2007 Marshall et al.
7,306,230 B2 12/2007 Lambert et al.
7,322,771 B1 1/2008 Marshall et al.
7,503,250 B2 3/2009 Lambert et al.
2005/0022658 A1 2/2005 Bateman
2006/0290063 A1 12/2006 Hagar
2006/0290064 A1 12/2006 Hagar

OTHER PUBLICATIONS

Duelatron, Product Literature 1995.
Law Enforcement Targets, Inc., Product Literature, Jul. 8, 2003.
Law Enforcement Targets, Inc., Product Literature, Oct. 12, 2004.
Law Enforcement Targets, Inc., Product Literature, Jun. 26, 2007.
Metal Spinning Target, Inc., Dueling Trees, Jul. 8, 2003.
Mike Gibson Manufacturing, Dueling Tree, Jul. 8, 2003.
Outwest Mfg. Products, Product Literature, Jul. 8, 2003.
Porta Target, Product Literature, Circa 2000.
Shootrite, Tactical Training Target, published prior to Apr. 4, 2005.

METHOD FOR USING A MULTIFUNCTION TARGET ACTUATOR

RELATED APPLICATIONS

The present application is a divisional application of U.S. Ser. No. 11/506,413, filed Aug. 17, 2006, which is incorporated by reference in its entirety, and claims the benefit of U.S. Provisional Application Ser. No. 60/709,992, filed Aug. 19, 2005.

BACKGROUND OF THE INVENTION

1. Field of the Invention

The present invention relates to a multifunction actuator for turning an object, such as a target, between distinct positions. In a preferred embodiment, the present invention relates to an actuator which allows a target to be turned 90 degrees in either direction from an initial starting point while providing improved control of the target through movement and at the stopping points.

2. State of the Art

In order to maintain proficiency in the use of firearms, it is common for law enforcement officers and sportsmen to engage in target practice. Target practice is traditionally conducted on a shooting range in which targets were placed a distance away from the shooter and the shooter is required to shoot and hit the target.

There are a variety of reasons that law enforcement officers, military personnel and the like (collectively referred to as law enforcement officers) engage in target practice. One reason is for self defense. For example, a substantial percentage of the police officers who are killed each year are killed within fifteen feet of the perpetrator. Many are killed within five feet—often within the confines of a house or other building. Thus, law enforcement officers must be able to quickly shoot and kill a person who would harm them.

Another reason that law enforcement officers must regularly engage in target practice is to prevent the officers from accidentally injuring an innocent party. Every year innocent third parties are killed during gun fire between law enforcement officers and criminals. By perfecting their shooting skills, law enforcement officers can minimize the number of accidental casualties.

Along this same line of concern are the number of accidental shootings that occur each year. A law enforcement officer may accidentally shoot an unarmed person based on the belief that the person is carrying a weapon. In a situation in which a weapon has been reported, a person may accidentally be shot because they were carrying a cellular telephone, a toy gun or some other item that is mistaken for a real weapon.

One of the best ways to avoid accidental shootings is to adequately train law enforcement officers so that they are comfortable with their own reaction times and abilities. If an officer knows that she can adequately assess a potential threat and respond in a very short amount of time, she will be less likely to fire at the first sight of a metallic object in the person's hand.

One of the most effective ways to train law enforcement officers to respond appropriately is to provide targets that may be either a criminal with a weapon, or an innocent person. After successfully completing numerous training scenarios, the law enforcement officers are better able to make a quick, accurate assessment of the risk and to respond accordingly.

One common method for training law enforcement personnel is by the use of a 180 degree turn target. The target has a first face on which an image is presented which is associated with a threat. For example, the target may include a photograph of a woman with a gun or a man with a knife, broken bottle, etc. The opposing side of the target is usually provided with an image which is not a threat. For example, a photograph of a woman carrying a baby or a man with a cellular telephone in his hand.

The target is usually held in an initial, concealed position parallel with the line of fire. As such, the law enforcement officer cannot see either face of the target. The target is then actuated to expose one side or the other. As the target turns and stops, the shooter must decide 1) whether the person constitutes a threat and 2) whether to fire. As will be appreciated by those of skill in the art, there may be times when the person on the target would pose a threat, such as a person who looks ready to fight, but which does not justify firing.

When the shooter is waiting, he or she does not know which face of the target will be exposed. Thus, while the shooter may know on a single faced target that it is a perpetrator or an innocent person and be able to anticipate the appropriate response, in a two faced target the shooter can never grow familiar with the target, as either face may be presented.

By repeating such training until there are no errors, the law enforcement officer can be more confident in his or her ability to respond both quickly and accurately to the situation. This lowers the stress for the law enforcement officers and makes potentially dangerous situations safer for everyone. When a potential threat appears, the law enforcement officer knows that in a fraction of a second he or she can determine if the person is a threat and respond appropriately.

Target actuators are used to move the target as described, to expose one of the target faces. Existing target actuators do not allow for fast and accurate positioning of the target, as well as repeated movement between the various desired target positions (having a particular side of the target or a particular target presented to the shooter, not presenting the target to the shooter).

There is a need for a target actuator which can move a target alternatively between multiple positions, such as presenting varying sides of a target as well as not presenting the target. Thus, there is a need for a simple and reliable target actuator which can be alternatively positioned between three or more positions so as to allow varying sides of a target to be selectively presented to a shooter as well as positioning the target so that it is not presented to the shooter.

Thus, there is a need for an improved actuator which enables a target to be more precisely controlled as it moves between positions along a 180 degree travel path. Such an actuator should also be relatively inexpensive and easy to use.

SUMMARY OF THE INVENTION

Thus, it is an object of the present invention to provide an improved actuator which provides improved control over an item being turned.

The above and other objects of the invention are achieved through a multifunction actuator which allows an actuator device to be affirmatively stopped at at least three locations along a travel path. This is accomplished pneumatically by a first drive piston, a second drive piston and a drive line which are connected to an actuator attachment. By selectively moving the first and second pistons, the drive line can be moved to cause the target to stop at a first position, a second position, and a third position between the first and second positions.

In accordance with one aspect of the present invention, the second piston is attached to the first piston, such that actuating the first piston moves the second piston.

In accordance with another aspect of the present invention, at least one of the pistons is attached to a drive line in the form of a flexible cable which engages a pulley to rotate the target. As the piston is moved between a first position and a second position, the flexible cable moves and rotates the pulley between a first actuator position and a second actuator position.

In accordance with another aspect of the present invention, the cable line may be affixed to the pulley to prevent sliding of the drive line with respect to the pulley.

In accordance with yet another aspect of the invention, the drive line may be a chain and the pulley may include a gear. Likewise, the piston may include teeth to engage a gear on the pulley so as to form a rack and pinion engagement. In use, the pistons are selectively actuated so as to cause rotation of the pulley, gear, shaft, etc., and thereby provide distinct stopping points for a target connected to the pulley or gear.

In accordance with another aspect of the present invention, a first piston is provided to move an arm, and the arm and the target and a second piston are carried by the arm. Movement of the second piston further moves the target.

In accordance with still another aspect of the invention, the first and second pistons are rotary pistons, the second rotary piston is attached to the first rotary piston, and the drive line is a shaft attached to the second rotary piston. Accordingly, movement of the second rotary piston turns the shaft to rotate the target, and movement of the first rotary piston moves the second rotary piston and thereby moves the target.

BRIEF DESCRIPTION OF THE DRAWINGS

The above and other objects, features and advantages of the invention will become apparent from a consideration of the following detailed description presented in connection with the accompanying drawings in which.

It will be appreciated that the drawings are exemplary of various aspects of the present invention and do not limit the invention to any specific embodiment shown.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 1:
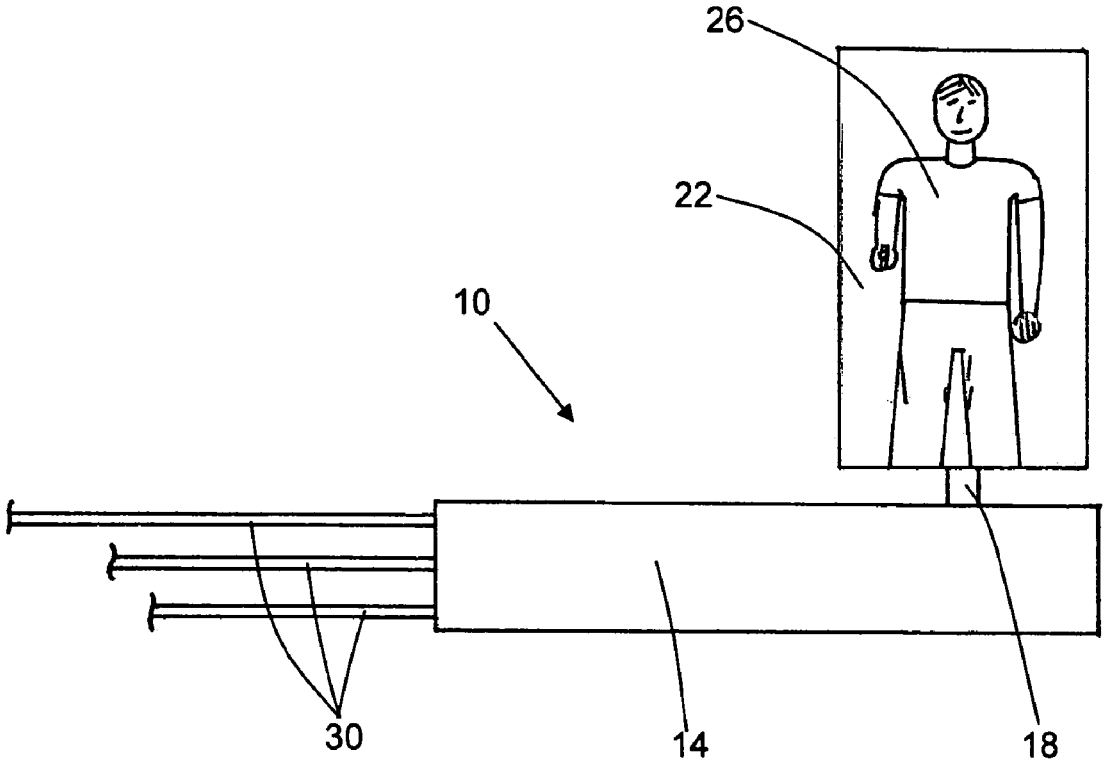
FIG. 1 shows a side view of a target attached to a target actuator in accordance with the principles of the present invention.

Referring to FIG. 1, there is shown a target actuator, generally indicated at 10, made in accordance with the principles of the present invention. The target actuator 10 includes a housing 14 and a drive shaft 18 which is attached to a target 22.

The target actuator 10 is configured to rotate the drive shaft 18 so that the target 22 may be disposed in three distinct positions. In a first position, target 22 is rotated so as to be parallel with the line of fire and so that neither face is exposed to the shooter. The target actuator 10 may be actuated to turn the target 22 in one direction approximately 90 degrees so that the target is in a second position to expose a picture or image 26 as shown in FIG. 1. In the alternative, the target 22 can be rotated so that the target stops approximately 90 degrees in the opposite direction so that the target is in a third position to expose the opposing face of the target.

In discussing the present invention, including all figures discussed herein, the various target positions are described as first, second, third, etc. It is appreciated that the actuators provide multiple positions for positioning a target, and that the positions are described as first, second, third, etc. as is convenient for describing the movement of the actuator and corresponding movement of the drive shaft (output shaft) which is used to rotate the target. Thus, the actuator may provide three, four, or more positions usable for positioning a target. These positions may be spaced apart in 90 degree increments, 120 degree increments, combinations of different angular increments, etc. The angular rotation, or spacing, between positions is typically determined by the requirements of the target or targets being presented to a shooter.

In describing possible uses of the target actuator, such as is shown in FIGS. 1, 12, 13, and 14, the rotational positions of the target or targets is also described as first, second, third, etc. positions. It is appreciated that the designations of the target positions have been chosen simply for convenience in describing the operation of the target and actuator. Often, a position where the target is not presented to a shooter is designated as the first position, but it is appreciated that for many uses of the actuator, one or more targets may always be presented to the shooter. In other situations, it may be more convenient to describe a position where a target is presented to a shooter as a first position and a position where a target is not presented to a shooter as another position. Thus, the particular designation of which position is designated as the first, second, third position, etc., is of no significance other than to distinguish from the other positions. The invention provides an actuator which is simple and reliable and which allows one or more targets mounted thereon to be moved between three or more rotational positions so as to selectively expose one or more targets to a shooter.

Also shown in FIG. 1 are a plurality of pneumatic lines 30. The pneumatic lines 30 are used to provide pressurized air to the target actuator 10 to thereby enable rotation of the target 22 between the desired positions.

Figure 2:
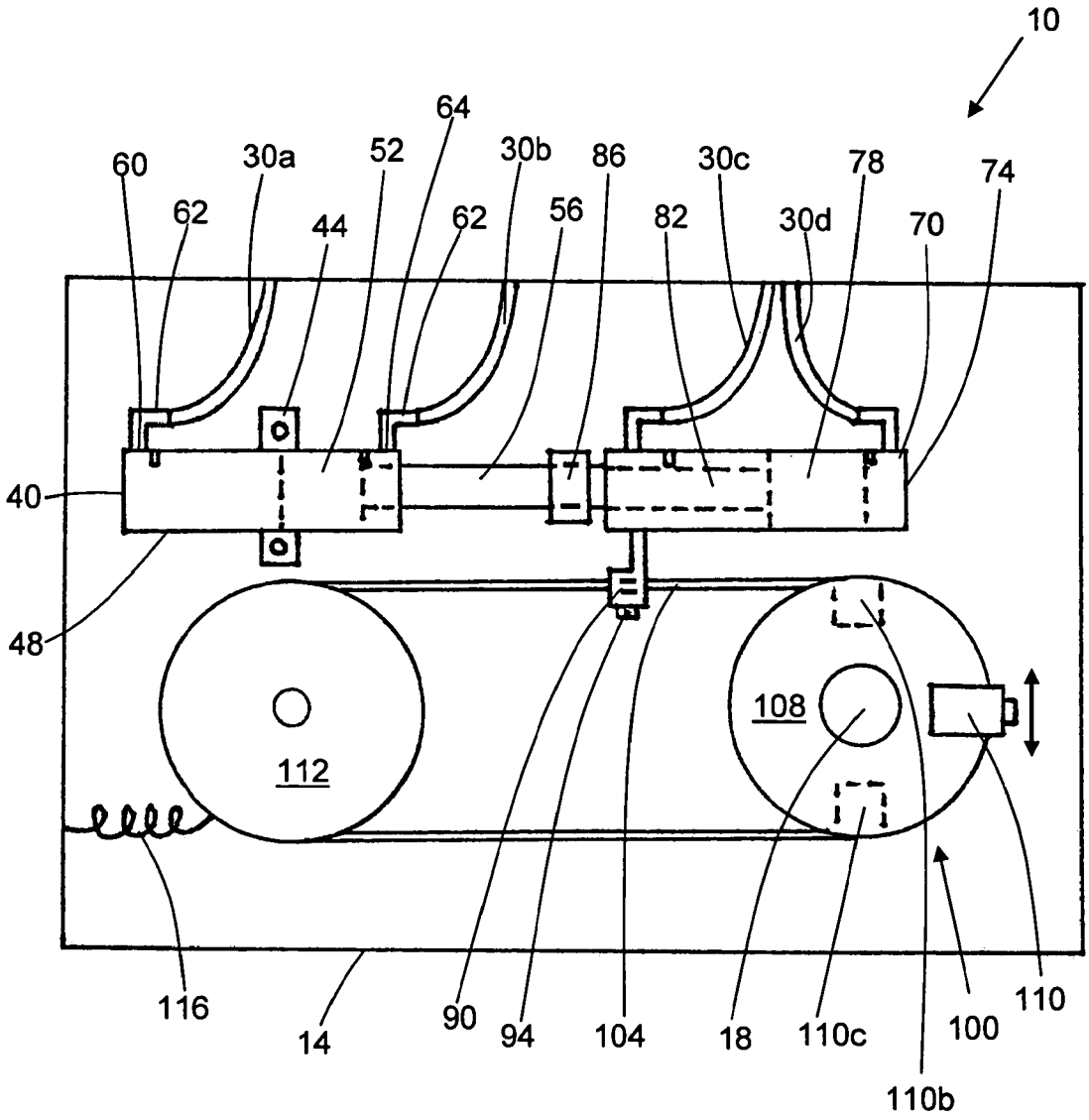
FIG. 2 shows plan view of the actuator of FIG. 1.

Turning now to FIG. 2, there is shown a plan view of the target actuator 10. Disposed within the housing 14 is a first pneumatic piston assembly 40 which is attached to the housing by a mounting bracket 44. The pneumatic piston assembly 40 includes a cylinder 48, a piston 52 which slides within the cylinder, and a rod 56 attached to the piston and extending beyond the cylinder. As pressurized air is injected into the cylinder through a port 60 adjacent one end of the cylinder 48, the piston 52 is forced toward the opposing end of the cylinder, thus moving the rod 56 outwardly. By releasing the pressure injected through port 60 and injecting air through port 64 adjacent the opposing end of the cylinder 48, the piston is pushed back toward the opposing end of the cylinder and the rod 56 is withdrawn partially into the cylinder. Thus, by selectively controlling air pressure in lines 30*a* and 30*b*, or by the use of valves 62, the piston 52 can be moved back and forth within the cylinder 48.

Attached to a distal end of the rod 56 is a second pneumatic piston assembly 70. The second pneumatic piston assembly 70 includes a cylinder 74, a piston 78 which slides within the cylinder, and a rod 82 which extends out of the cylinder. As shown in FIG. 2, the rod 82 is attached to the rod 56 of the first pneumatic piston assembly 40. This can be accomplished by a removable fastener, such as a nut or collar 86, engaging threads on the rods, or by more permanent techniques, such as by welding.

Unlike the first pneumatic piston assembly 40, the second pneumatic piston assembly 70 is not fixedly attached to the housing. Thus, when the first pneumatic piston assembly 40 is actuated to move the rod 56, the second pneumatic piston assembly 70 moves in like direction and to the same degree. Thus, as shown in FIG. 2, the rod 56 is extended, causing the second pneumatic piston assembly 70 to be in a middle position which, as will be explained below, may correlate with the initial position of the target. If the rod 56 is withdrawn, the second pneumatic piston assembly 70 will be moved to the left, while extending the rod 82 will move the piston cylinder 74 further to the right.

The cylinder 74 of the second pneumatic piston assembly 70 is attached by an arm 90 to a drive line, generally indicated at 100. The drive line 100 translates the linear motion of the cylinders into rotational movement of the target 22 (FIG. 1). As shown in FIG. 2, a set screw 94 is used to secure the arm 90 to the drive line 100 and to ensure that movement of the arm 90 translates into movement of the drive line.

The drive line 100 shown in FIG. 2 includes a cable 104 which is wrapped around a pulley 108 and attached to the pulley with a set screw 110 to ensure that movement of the cable creates corresponding movement of the pulley 108. The cable 104 may also be wrapped around a second pulley 112 to provide a cable which forms a complete loop. A tensioning spring 116 may be used to keep the cable taut, such as by pivotally mounting pulley 112 to the housing 14 and using spring 116 to bias pulley 112 away from pulley 108.

The pulley 108 is connected to the drive shaft 18 which rotates the target. Preferably, this is accomplished by having the drive shaft 18 serve as the axle about which the pulley 108 rotates. It is equally feasible to provide a separate drive shaft 18 and pulley axle (or gear drive, etc.), and operatively connect the two together with a coupler, etc.

As shown in FIG. 2, the pulley 108 is disposed in a position wherein the target 22 (FIG. 1) will be in its initial position where it is not exposed to the shooter. If the pneumatic line 30*b* is pressurized so that the piston 52 moves to the opposing end of the cylinder 40 in the first pneumatic piston assembly 40, the second pneumatic piston assembly 70 is moved to the left. This causes the arm 90 to move the cable 104 and turns the pulley 108 counterclockwise until the set screw 110 is in the position shown at 110*b*. As the pulley 108 rotates, the drive shaft 18 rotates 90 degrees and exposes one face of the target 22 (FIG. 1).

In contrast, if the first pneumatic piston assembly 40 remains as shown and the airline 30*d* is pressurized to move the piston 78 to the opposing side of cylinder 74 in the second pneumatic piston assembly 70, the cylinder 70 will move further to the right. The arm 90 which is attached to the cylinder 70 also moves to the right, rotating the pulley 108 clockwise so that the set screw 110 is disposed in the position indicated at 110*c*. In this position, the opposing face of the target 22 (FIG. 1) is exposed. Thus, by using the lines 30*a*-30*d* to selectively move the pistons 52 and 78, a user can affirmatively control the position of the target at the different stopping points while using a pneumatic system.

Figure 12:
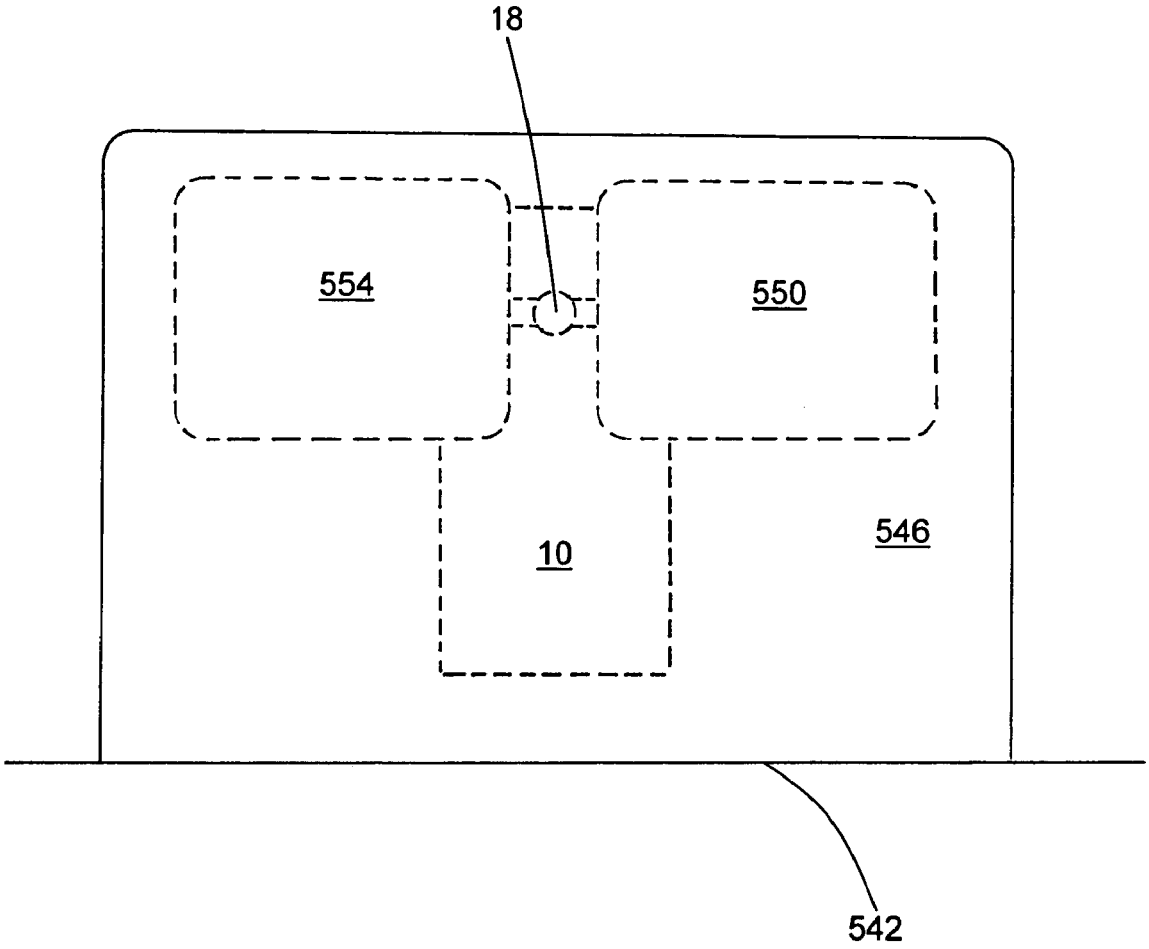
FIG. 12 shows a front view of an application of a multifunction actuator of one embodiment of the present invention.
Figure 13:
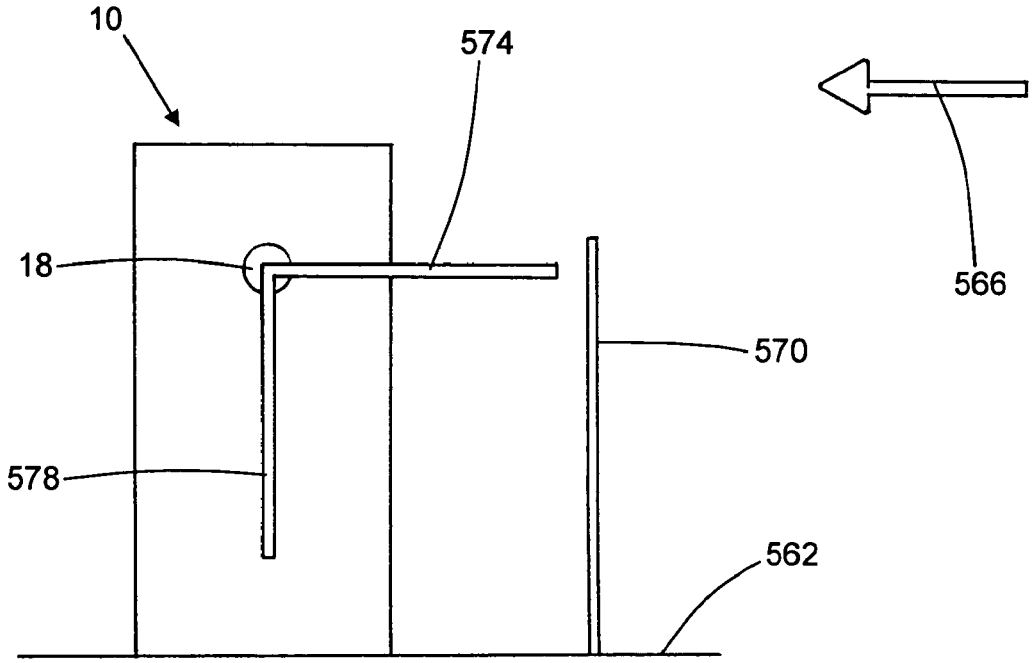
FIG. 13 shows a side view of an application of a multifunction actuator of one embodiment of the present invention.
Figure 14:
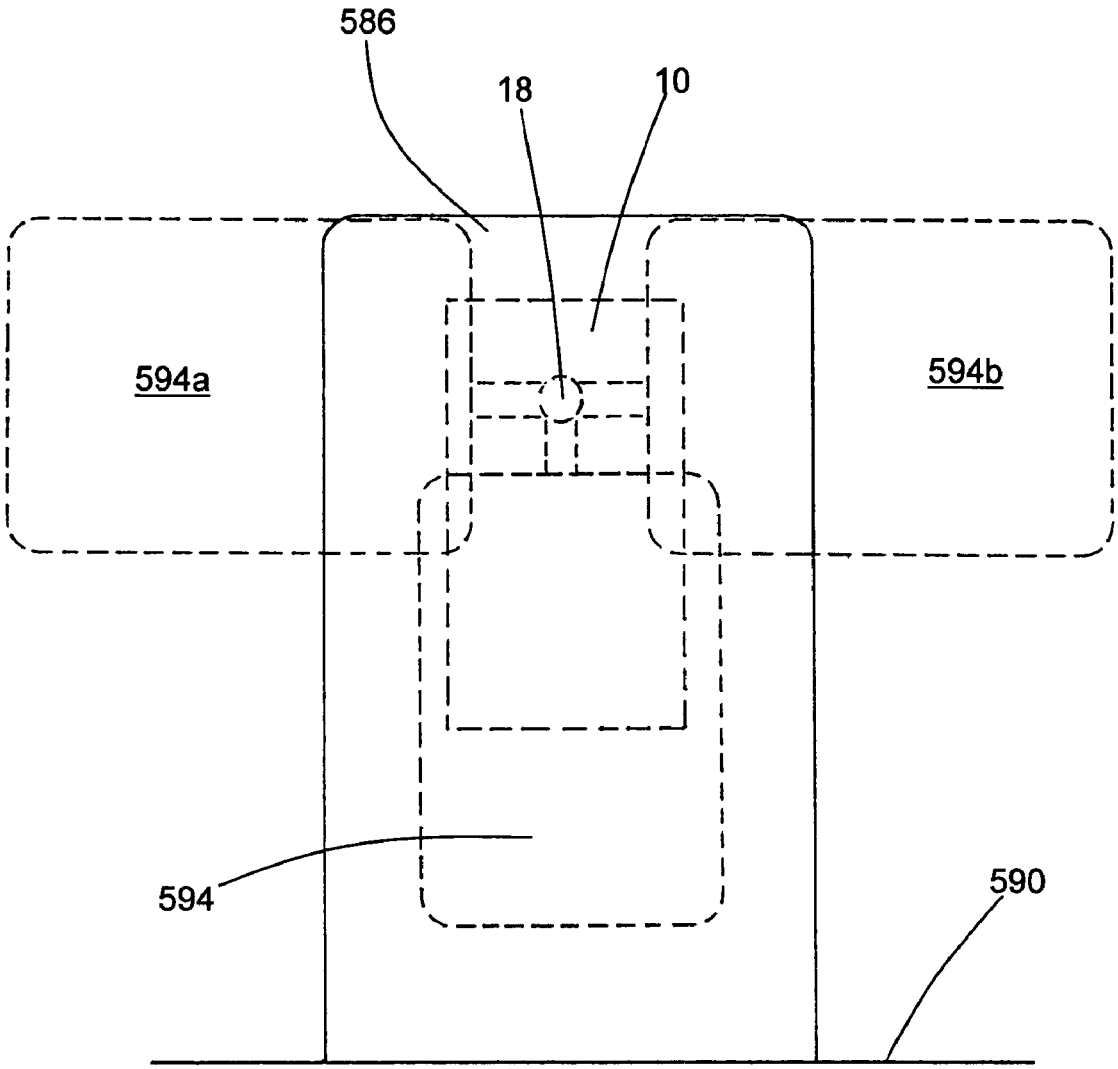
FIG. 14 shows a front view of still another application of a multifunction actuator of one embodiment of the present invention.

It is appreciated that the actuator shown in FIG. 2 may be used with other types of targets, such as are shown in FIGS. 12-14. The same actuator may be used with many different types and combinations of targets to selectively expose different target surfaces to a shooter. The designations of first, second, third positions as used herein is for convenience only in describing the operation of the target.

Figure 3:
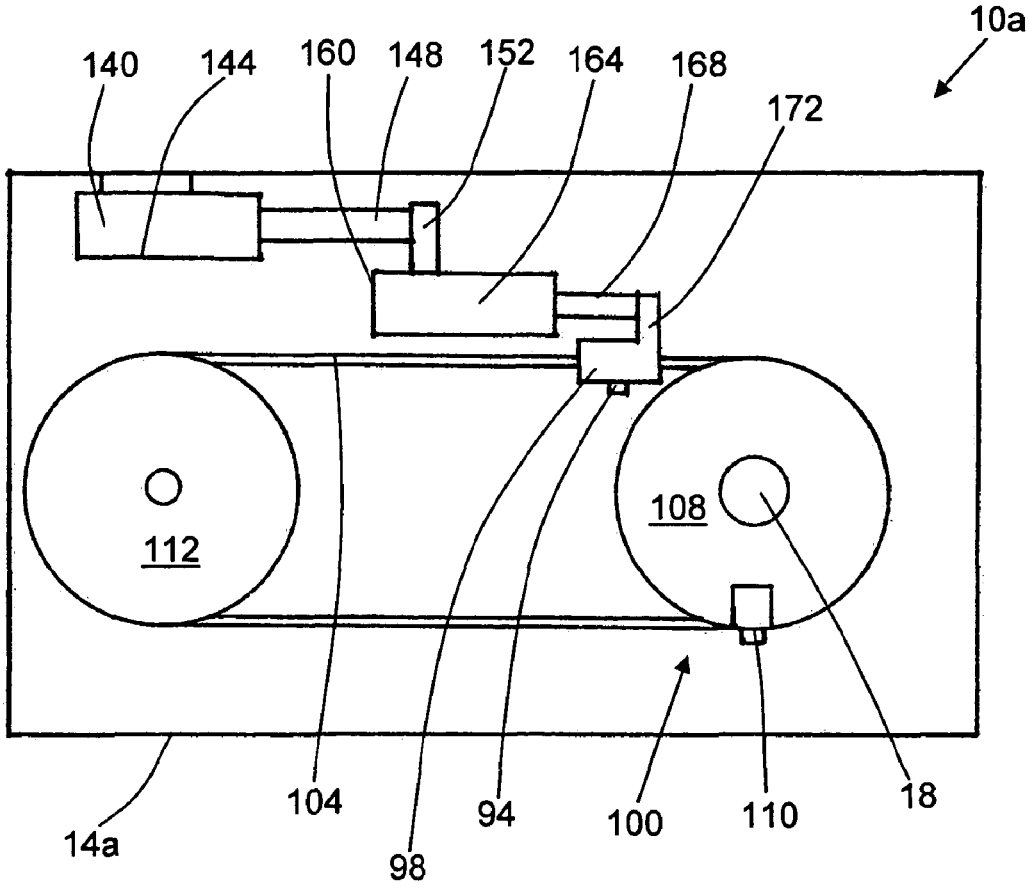
FIG. 3 shows a plan view of an alternate configuration of an actuator made in accordance with the principles of the present invention.

Turning now to FIG. 3, there is shown an alternate embodiment of the actuator 10 shown in FIG. 2. The housing 14*a* includes a first pneumatic piston assembly 140 with a cylinder 144, a piston (not shown) and a rod 148. The rod is attached by a nose bracket 152 to a second pneumatic piston assembly 160, which includes a piston cylinder 164, a piston (not shown) and a rod 168. The rod 168 also has a nose bracket 172 which acts as an arm and attaches the rod to the drive line 100.

As with the embodiment in FIG. 2, the drive line 100 translates the linear motion of the cylinders into movement of the target. Thus, a set screw 94 and housing 98 may be used to secure the nose bracket 172 to the drive line 100 and to ensure that movement of the nose bracket 172 translates into movement of the drive line.

The drive line 100 shown in FIG. 3 includes a cable 104 which is wrapped around a pulley 108 and a set screw 110 to ensure that movement of the pulley 108 corresponds with movement of the cable 104. The cable 104 may also be wrapped around a second pulley 112 to provide a cable which forms a complete loop. Of course, the cable 104 could terminate in a biasing member if desired so that a second pulley is not necessary.

As with the embodiment in FIG. 2, The pulley 108 is connected to the drive shaft 18 which rotates the target. Preferably, this is accomplished by having the drive shaft 18 serve as the axle about which the pulley 108 rotates. It is appreciated that the pulley may be replaced with gears, a chain drive, or other drives. While the desired movement of the piston assemblies 140 and 160 will depend on the diameter of the pulley 108, in a currently preferred embodiment each piston assembly provides approximately 1.5 inches of travel upon actuation. Thus, the total movement of the cable 104 is approximately 3 inches, resulting in a rotation of 180 degrees of the pulley 108, and the same amount of rotation in the drive shaft 18. Thus, the circumference of the pulley 108 would preferably be 6 inches, four times the stroke length of each piston assembly, and the stroke lengths of the piston assemblies are preferably the same, resulting in 90 degree rotation increments of the target With the position shown in FIG. 3, the target (FIG. 1) would be in an exposed position. By actuating either of the pneumatic piston assemblies 140 or 160, the cable 104 will be moved counterclockwise 1.5 inches, resulting in a 90 degree rotation of the pulley 108 and the drive shaft 18. This will return the target to the initial, concealed position where neither face is exposed to the shooter.

Actuating the other piston assembly 140 or 160 moves the cable 104 counterclockwise another 1.5 inches, rotating the pulley 108 and the drive shaft 18 another 90 degrees and placing the target so that the opposing side is exposed.

One advantage of disposing the pneumatic piston assemblies side by side as shown in FIG. 3 is space. When the assemblies are placed end to end, the housing may need to be relatively long to hold all of the components. In FIG. 3, however, the first pneumatic piston assembly 140 can be attached to the second pneumatic piston assembly 160 adjacent the distal end (i.e. near the rod) so that the total length of the assemblies is little more than that of one individually. To further save space, the pulleys 108 and 112 can be placed closer together.

Figure 4:
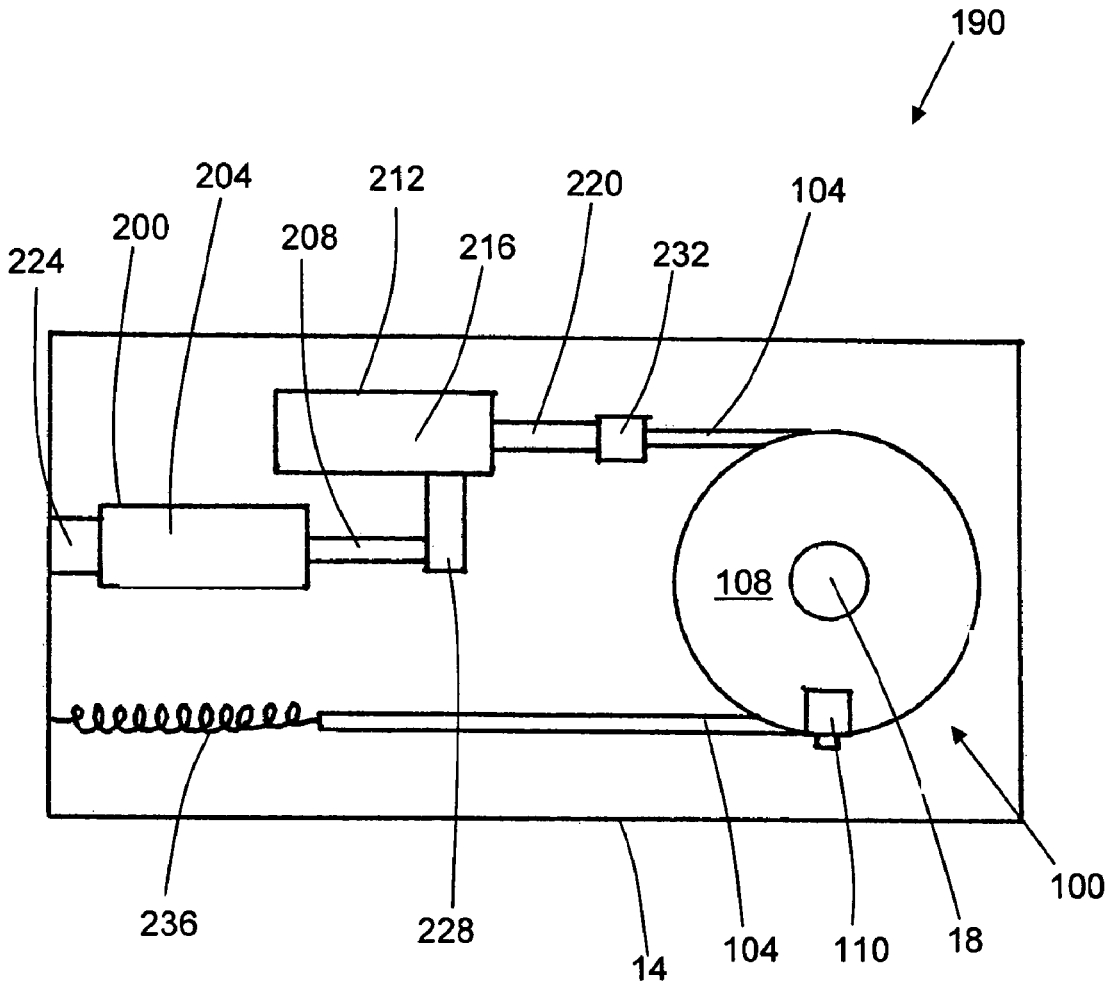
FIG. 4 shows a plan view of an alternate embodiment of an actuator and drive line in accordance with the principles of the present invention.

Turning now to FIG. 4, there is shown another embodiment of a target actuator, generally indicated at 190, according to aspects of the present invention. The target actuator utilizes a first pneumatic piston assembly 200 having a cylinder 204, piston (not shown), and a rod 208, and a second pneumatic piston assembly 212 having a cylinder 216, piston (not shown) and rod 220. The first cylinder 204 is mounted to the housing 14 via a bracket 224. The rod 208 is attached to the cylinder 216 of the second pneumatic piston assembly 212 with a bracket 228, such that as the rod 208 is moved in and out of the cylinder 204, the second piston assembly 212 is moved with the rod 208. The rod 220 of the second piston assembly 212 is connected to the cable 104 of drive line 100 via bracket 232. Thus, as the first and second pneumatic piston assemblies 200, 212 are actuated, the cable 104 is moved in a manner as previously discussed. The cable 104 extends around pulley 108 and is attached to the pulley 108 with a bracket and set screw 110 such that movement of the cable 104 results in rotation of the pulley 108. The pulley 108 is operatively connected to the shaft 18 which turns the target 22 (FIG. 1). A biasing element 236, such as a spring or elastic member, is used to apply tension to the cable 104 and thereby ensure rotation of the pulley 108 as the pneumatic assemblies 200, 212 are moved into extended positions. Thus, the target actuator shown in FIG. 4 functions in a manner similar to that previously discussed.

Figure 5:
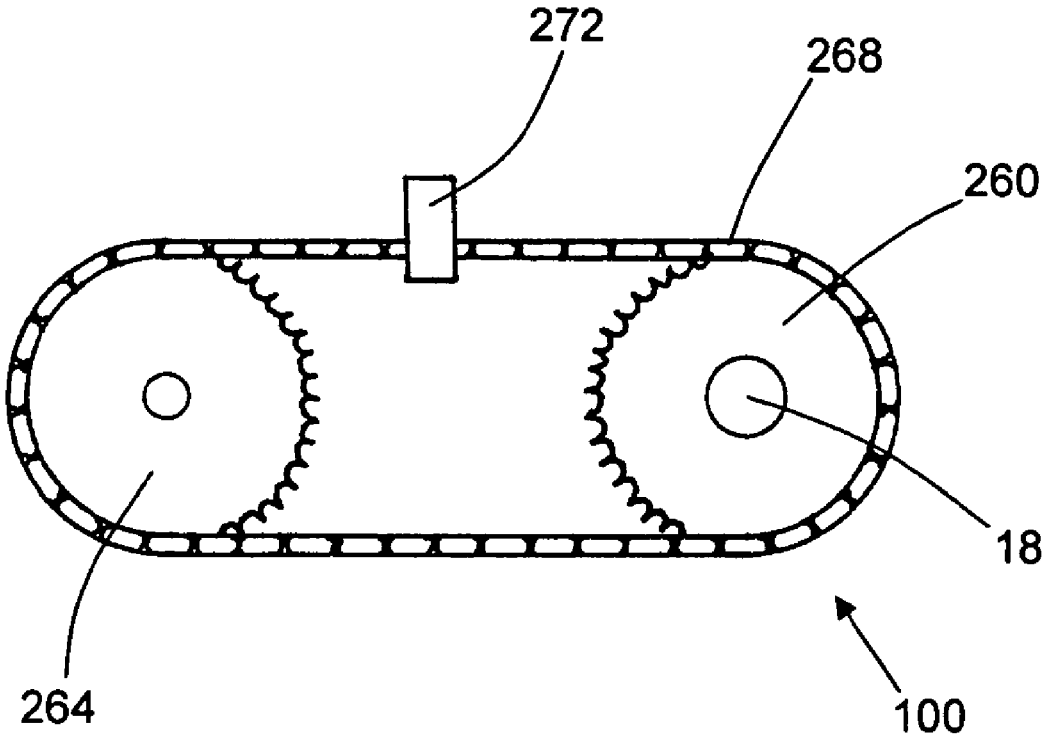
FIG. 5 shows a plan view of an alternate embodiment of a drive line in accordance with the principles of the present invention.

It will be appreciated, however that numerous variations of the present invention are possible. Turning to FIG. 5, a plan view of a drive line according to the present invention is shown. The drive line 100 utilizes a first sprocket 260 and second sprocket 264 in place of pulleys and uses a chain 268 in place of a cable. The chain 268 provides a positive engagement with sprocket 260, ensuring that the sprocket 260 is turned as the chain 268 is moved. A bracket 272 may be used to attach the chain 268 to the pneumatic assemblies as has been previously discussed. It will also be appreciated that hydraulic assemblies may be used in place of pneumatic assemblies in substantially the same manner. Pressurized air is more commonly available at shooting ranges, however, and the pneumatic operation of the target actuator is thus preferred.

Figure 6:
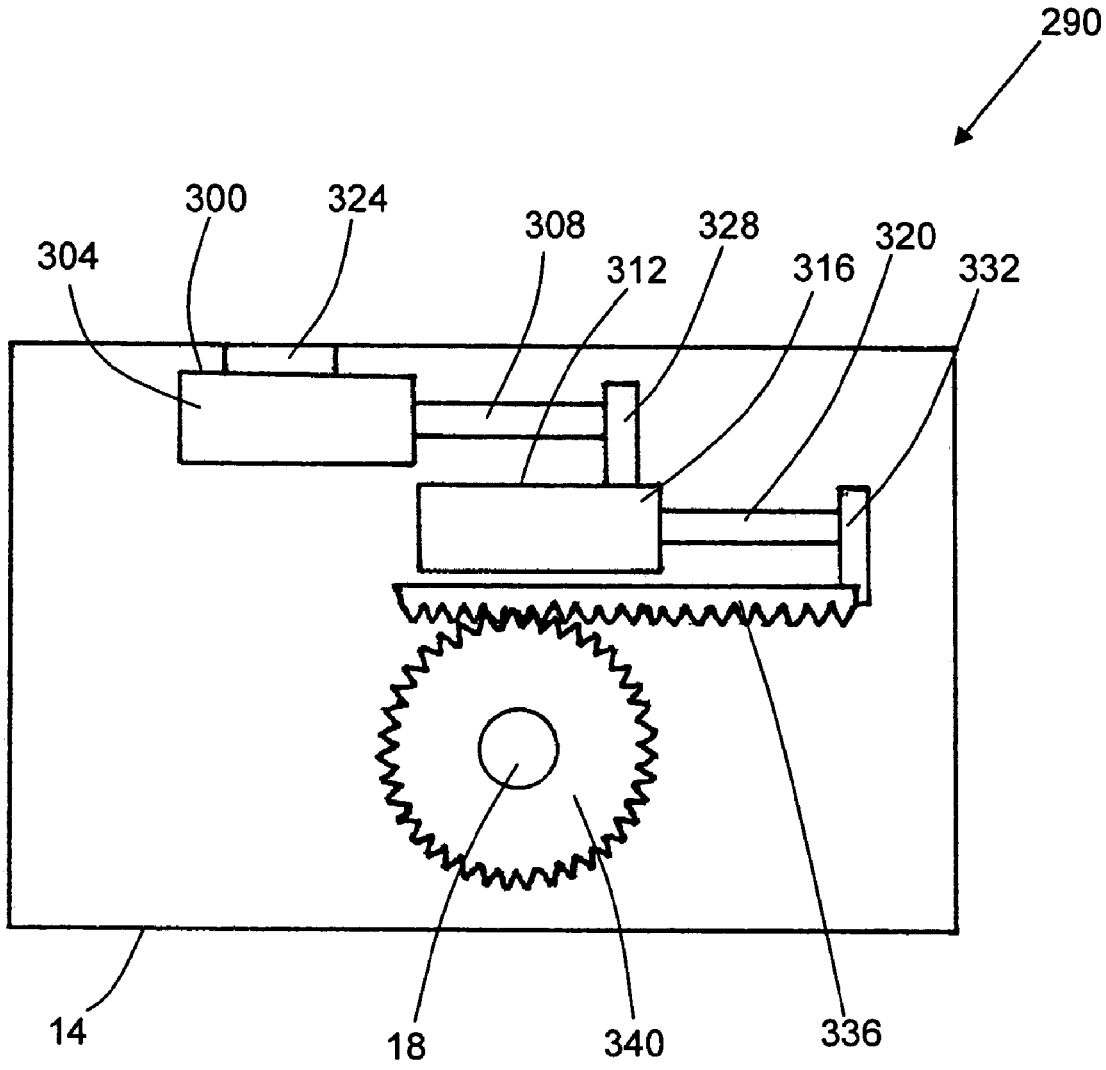
FIG. 6 shows a plan view of yet another alternate embodiment of an actuator in accordance with the principles of the present invention.

Turning now to FIG. 6 a plan view of another target actuator, generally indicated at 290, is shown according to the present invention. The target actuator 290 again utilizes a first pneumatic piston assembly 300 having a cylinder 304, piston (not shown) and rod 308, and a second pneumatic piston assembly 312 having a cylinder 316, piston (not shown), and rod 320. The first cylinder 304 is attached to the housing 14 by a bracket 324. It will be appreciated that in any of the embodiments, the pneumatic piston assembly could be welded, glued, or otherwise attached to the housing. The first rod 308 is attached to a bracket 328 which is in turn attached to the second cylinder 312. The second rod 320 is attached to a bracket 332 which is attached to a toothed plate 336, which engages gear 340 (similar to a rack and pinion assembly). The gear 340 is operatively connected to shaft 18 and thereby to target 22 (FIG. 1).

Thus in operation, extending the first rod 308 also moves bracket 328, piston assembly 312, and toothed plate 336, thereby rotating gear 340. Extending second rod 320 moves toothed plate 336 and thereby rotates gear 340, thereby rotating target 22 (FIG. 1). The piston assemblies 300, 312 are shown in a fully extended position in FIG. 6, and subsequent retraction of the rods 308, 320 will move the toothed plate 336 to the left and rotate the gear 340 in a counterclockwise direction. Pneumatic lines and other details have been omitted from the drawings for clarity, but work in a similar manner to that discussed above.

Figure 7:
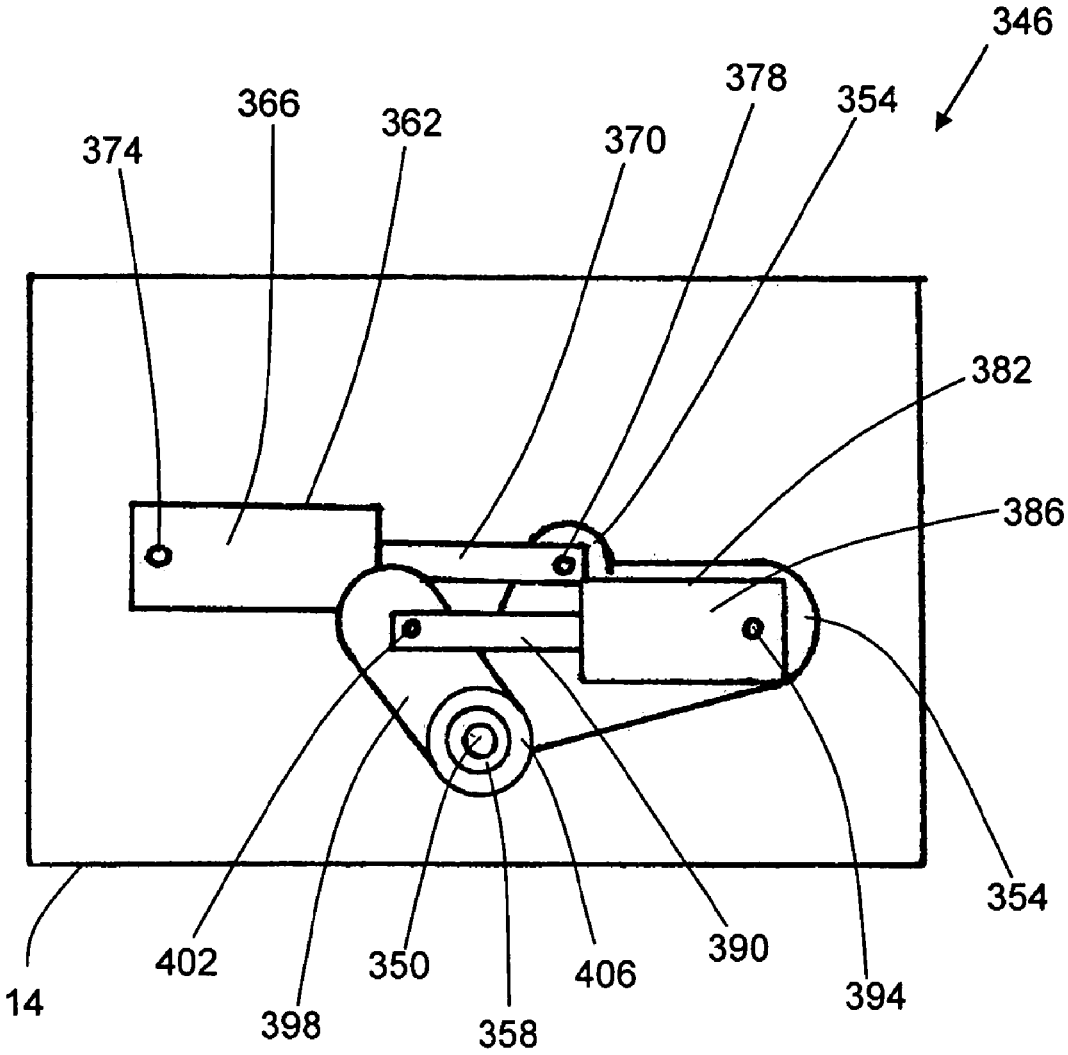
FIG. 7 shows a plan view of another actuator in accordance with principles of the present invention.

Turning now to FIG. 7, a plan view of yet another embodiment of a target actuator, generally indicated at 346, is shown. The target actuator housing 14 has a pivot shaft 350 mounted thereto. A first pivot plate 354 is attached to a first pivot tube 358, the first pivot tube 358 being configured to fit over the pivot shaft 350 and allow the first pivot plate 354 to rotate. A first pneumatic piston assembly 362, comprising a cylinder 366, piston (not shown), and rod 370. The cylinder 366 is pivotally attached to the housing 14 at pivot 374 and the end of the rod 370 is pivotally attached to the first pivot plate 354 at pivot 378 such that when the piston assembly 362 is actuated to extend or retract the rod 370 the first pivot plate 354 pivots about pivot shaft 350. The distance between pivot 378 and pivot shaft 350 and the stroke length of the first piston assembly 362 may be adjusted such that the movement of the first piston assembly causes the first pivot plate to rotate back and forth by 90 degrees, or by any other desired movement range.

A second pneumatic piston assembly 382, comprising a cylinder 386, piston (not shown), and rod 390, is disposed such that the cylinder 386 is pivotally attached to the first pivot plate 354 at pivot 394, and the end of the rod 390 is pivotally attached to a second pivot plate 398 at pivot 402. The second pivot plate 398 is attached to a second pivot tube 406 which fits over first pivot tube 358 and allows the second pivot plate 398 to rotate independent of the first pivot plate 354. Thus, when the second pneumatic cylinder 382 is actuated to extend and retract the rod 390, the second pivot plate 398 rotates independent of the first pivot plate 354.

The size of the second pivot plate 398 and the stroke length of the second pneumatic piston assembly 382 may be adjusted to adjust the angle of rotation of the second pivot plate. Air lines would typically be used to attach the piston assemblies 362, 382 to an air source, but have been omitted for clarity. Thus, in operation a bullet target 22 (FIG. 1) would be operatively connected to the second pivot tube 406 such that the target pivots when the tube 406 pivots.

Either of the first and second piston assemblies 362, 382 may be actuated to rotate the target 22 (FIG. 1). If both piston assemblies 362, 382 and pivot plates 354, 398 are adjusted to provide 90 degree movements, the target may then be rotated between a first position wherein a first side (or surface or face)

of the target is presented to a shooter, a second position wherein the target is not presented to the shooter (a target edge and not a face is towards the shooter), and a third position wherein a second side of the target opposite the first side is presented to the shooter. If the pistons and mechanical assemblies are configured so that each actuation moves the output shaft 18 by the same angular amount, such as 90 or 120 degrees, extension of either piston would rotate the shaft by the selected angle, and extension of the remaining piston would further rotate the output shaft by the selected angle.

Alternatively, the actuator may be configured so that extension of each of the pistons rotates the output shaft by different amounts. Thus, extension of the first piston may rotate the output shaft by 90 degrees and extension of the second piston may rotate the output shaft by nearly 180 degrees. An operator could then rotate a target between a first position where both pistons are retracted (0 degrees rotation of the target), a second position where only the first piston is extended (90 degrees rotation), a third position where only the second piston is extended (nearly 180 degrees rotation), and a fourth position where both the first and second pistons are extended (nearly 270 degrees rotation). Any of the various actuator configurations disclosed herein may thus operate by selecting the pistons and connecting linkages so as to provide the desired rotational travel.

Figure 8A:
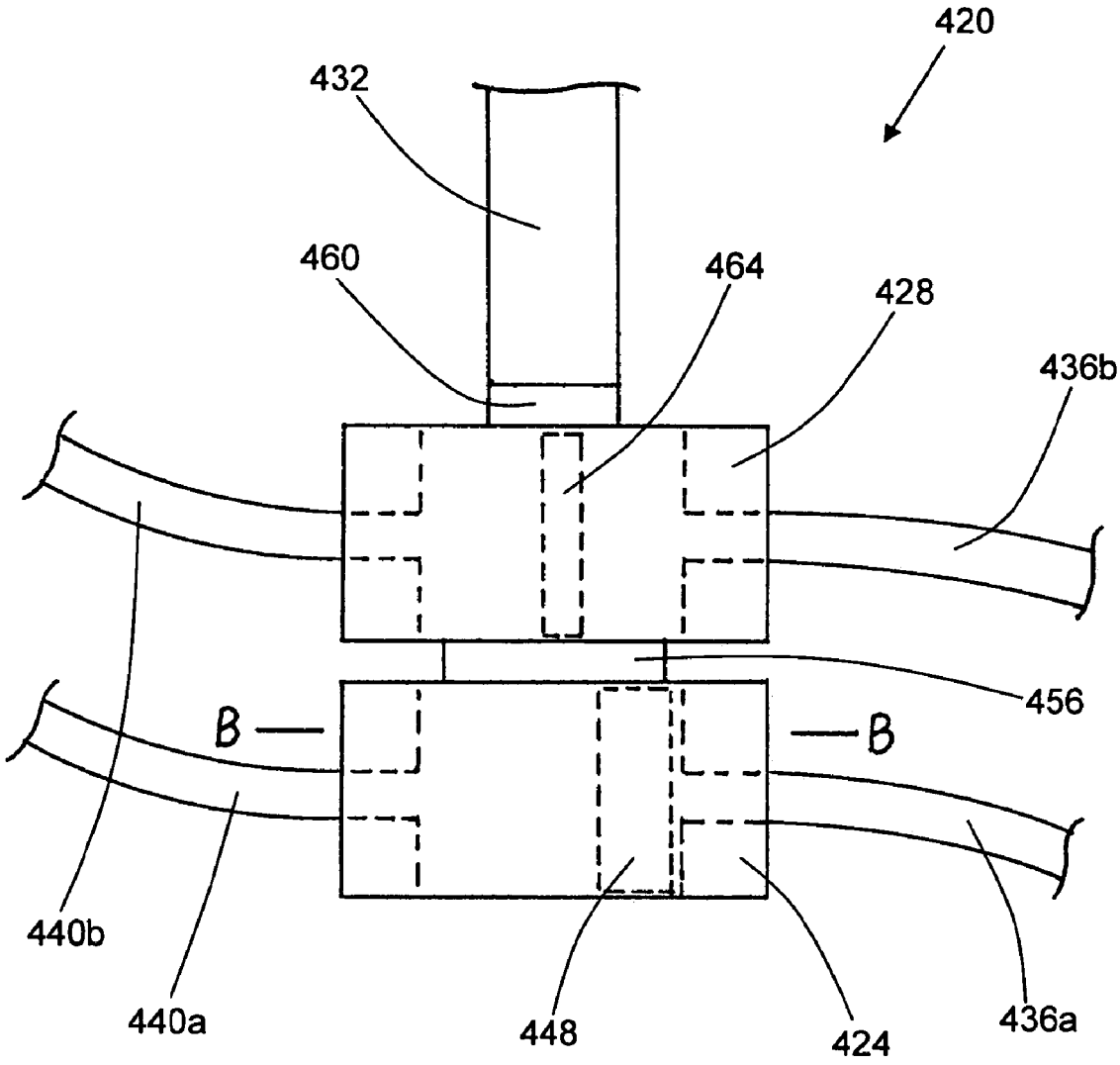
FIG. 8A shows a side view of another actuator embodiment in accordance with aspects of the present invention.

Referring to FIG. 8A, a side view of another multifunction actuator according to the present invention is shown. The actuator, indicated generally at 420, utilizes a first rotary piston 424 and a second rotary piston 428 to thereby rotate a shaft 432 which is operatively coupled to a bullet target, such as target 22 of FIG. 1. A number of air lines 436*a*, 436*b* are attached to the rotary pistons 424, 428 and are used to actuate the pistons.

Actuating the air line 440*a* moves vane 448 and thereby moves shaft 456, rotary piston 428, and shaft 432. Similarly, actuating air line 440*b* moves vane 464 and thereby moves shaft 432. Thus, if both vanes 448, 464 are to the left, the shaft 432 will be in a far left position. Moving one vane 448 or 464 will move the shaft 432 to an intermediate position, and moving both vanes 448 and 464 to the right will move shaft 432 to a far right position. The rotational valves may be designed to allow for differing angular movement of the vanes as is desired to provide different angular rotation of the targets.

Figure 8B:
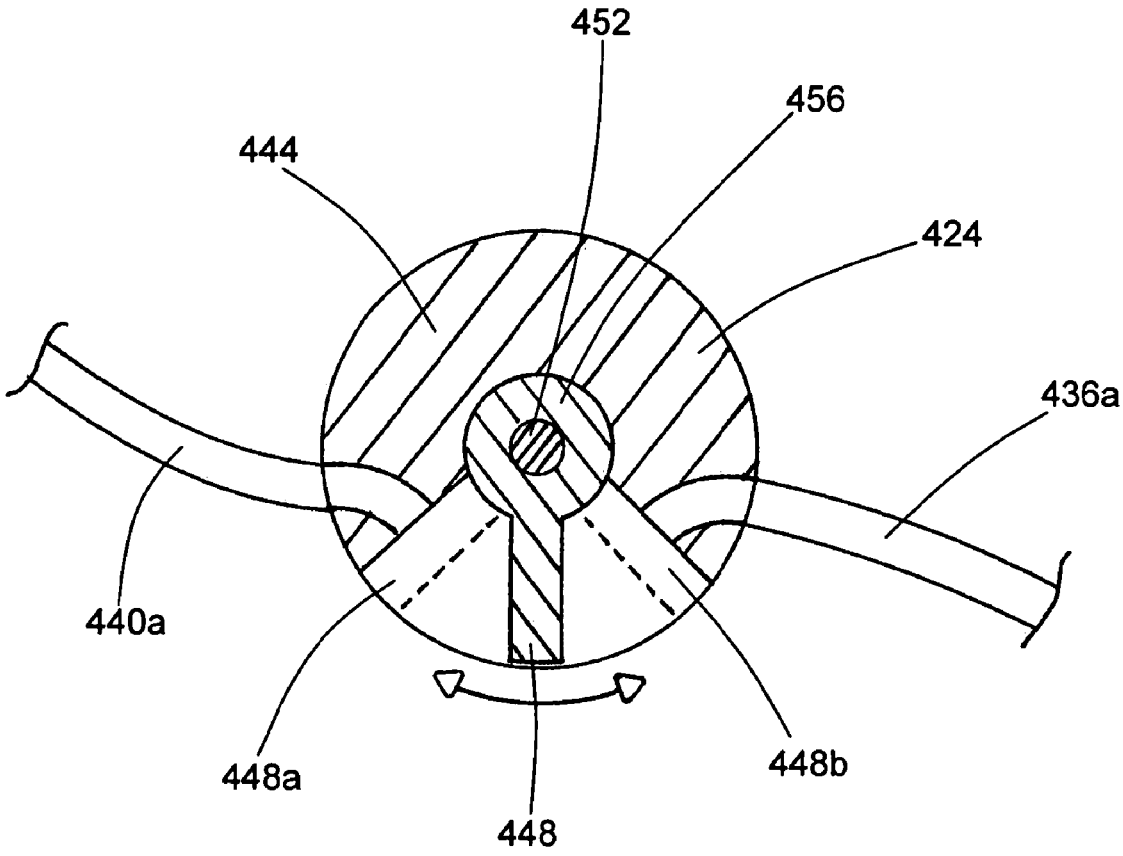
FIG. 8B shows a cross-sectional view of a rotary piston according to aspects of the present invention and taken along line B-B of FIG. 8A.

Turning to FIG. 8B, a cross sectional view of a rotary piston taken along line B-B of FIG. 8A. The rotary piston 424 has a housing 444 and a vane 448 which is pivotally mounted inside of the housing such that the vane 448 can rotate between a first position 448*a* and a second position 448*b*. The vane 448 may or may not be mounted on a pivotal axis 452, and would typically be attached to a shaft 456 which extends from the rotary piston 424 and transfers the rotation of the vane 448 to another object.

In operation, air is injected into the rotary piston 424 through air line 436*a* and any air pressure in air line 440*a* is released, forcing the vane to rotate into position 448*a*. Air pressure in air line 436*a* may then be released and air pressure introduced into line 440*a*, moving the vane into position 448*b*. This particular rotary piston 424 is configured to allow 90 degrees of rotation of the vane 448 and shaft 456.

Referring back to FIG. 8A, the shaft 456 of rotary piston 424 is attached to the housing of rotary piston 428 such that when the vane 448 and shaft 456 of rotary piston 424 are moved, rotary piston 428 moves therewith. As the target 22 (FIG. 1) is operatively coupled to the shaft 460 and vane 464 of rotary piston 428, movement of the rotary piston 428 also moves the target. Additionally, movement of vane 464 and shaft 460 of rotary piston 428 also move the target 22 (FIG. 1). If both rotary pistons 424, 428 are configured to provide 90 degrees of rotation to the vane 448, 464 and shaft 456, 460, the target 22 (FIG. 1) may be rotated through 180 degrees with positive stops as 0, 90, and 180 degrees. Thus, the actuator assembly of FIG. 8A and FIG. 8B may be used to present the opposite sides of a target and also to place the target so as not to be presented to a shooter as previously discussed. The target actuator 420 would be typically placed in a housing as previously discussed.

Figure 9:
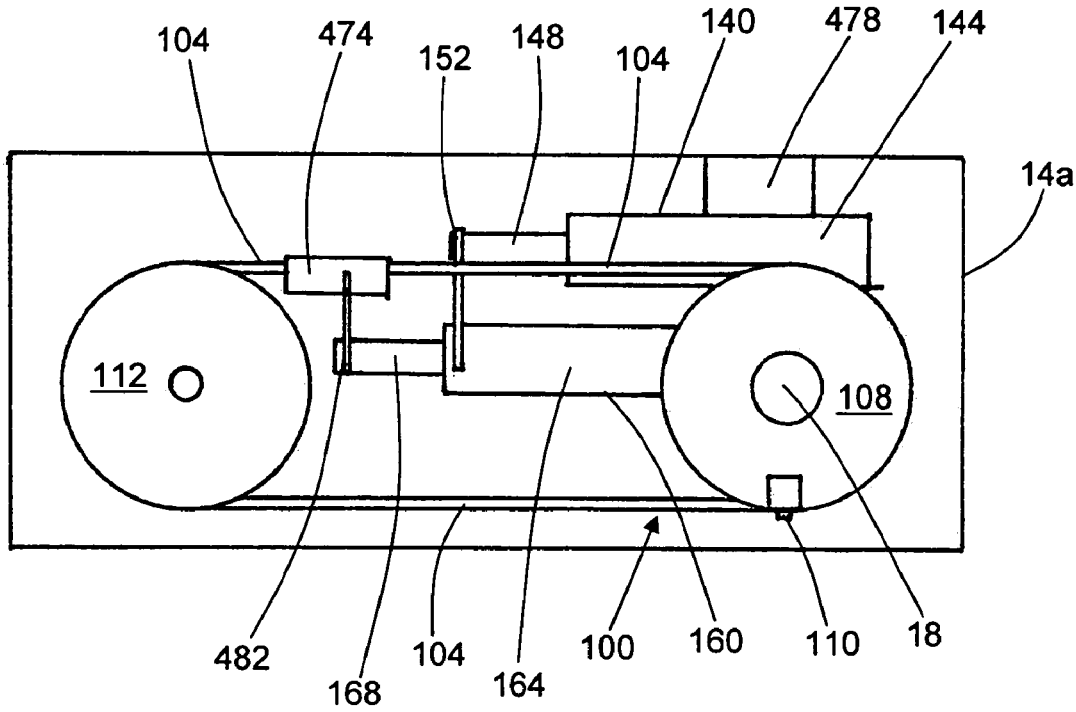
FIG. 9 shows a plan view of yet another configuration in accordance with aspects of the present invention.

Turning now to FIG. 9, a plan view of another multifunction actuator is shown. Similar to previous embodiments, a drive shaft 18 which actuates a target is attached to a pulley 108. Another pulley 112 is operatively connected to pulley 108 by a drive line 100. The drive line 100 includes a cable 104 and a bracket 474. The cable 104 is attached to pulley 108 by a bolt or set screw 110 to ensure that movement of the cable 104 creates corresponding movement of the pulley 108. A first pneumatic piston 144 including a cylinder 144, piston (not shown) and rod 148 is attached to housing 14*a* via bracket or another suitable mounting device or means. The rod 148 of first piston 140 is attached via bracket 152 to second pneumatic piston 160 which includes a cylinder 164, a piston (not shown), and a rod 168. Bracket 474 connects the two ends of cable 104 and also attaches the cable 104 to the rod 168 of the second pneumatic piston 160 via arm 482.

Thus, actuation of the first piston assembly 140 moves the second piston assembly 160 and thereby moves the bracket 474 and rotates the pulley 108 and shaft 18. Similarly, actuation of the second piston assembly 160 rotates the shaft 18 as described. Operation is thus similar to the device shown in FIG. 3. FIG. 9 shows that the piston assemblies 140, 160 may be moved beneath the pulleys 180, 112 so as to reduce the overall size of housing 14*a*. It will be appreciated that many configurations are thus possible with the present invention, allowing for use in a variety of applications.

Figure 10:
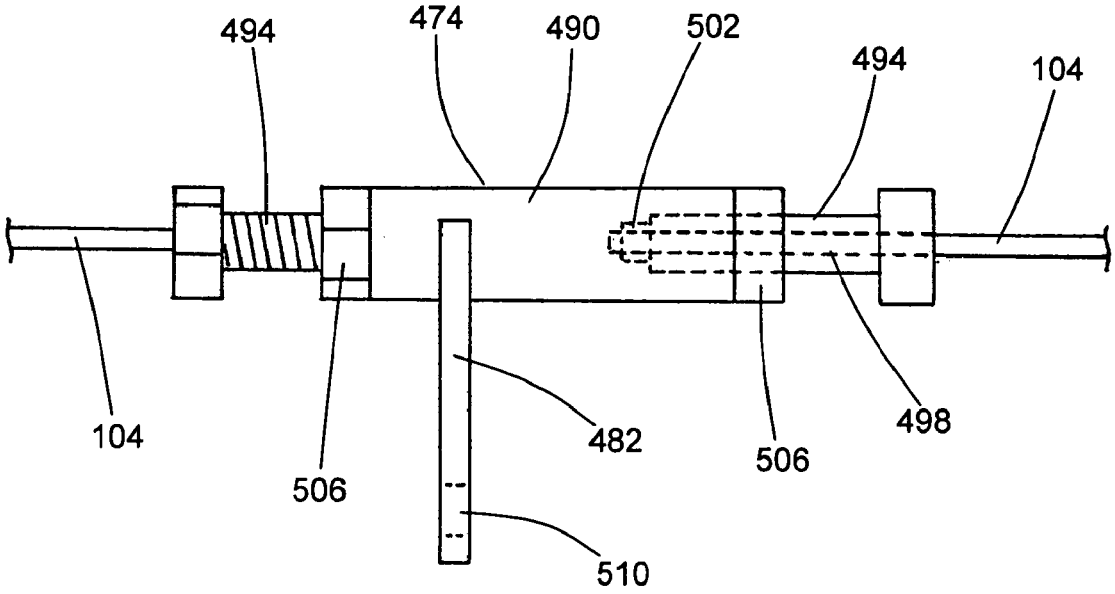
FIG. 10 shows a close-up view of a bracket as may be used in the present invention.

Turning now to FIG. 10, a side view of a bracket according to the present invention is shown. The bracket 474 is similar to that shown in FIG. 9 and used to connect the ends of cable 104. A tubular body 490 is internally threaded so as to receive bolts 494. The bolts 494 have a hole 498 formed along the axis of the bolts 494 so as to receive the ends of the cable 104. The cable ends 104 are passed through the holes 498 in the bolts 494 and secured to the bolts 404. The cable 104 may be secured to the bolts 494 by welding the cable to the bolt end, or by placing a collar 502 over the cable 104 which prevents the cable 104 from pulling out of the bolt 494. A collar 502 is advantageous as it does not prevent the cable 104 from rotating within the bolt 494.

After attaching the cable 104 to the bolts 494, nuts 506 are threaded onto the bolts 494. The bolts 494 are then threaded into the body 490 so as to hold the cable 104 tightly around the pulleys 108, 112 as shown in FIG. 9. The nuts 506 are then tightened against the body 490 to prevent the bolts 494 from unscrewing from the body 490 and allowing the cable 104 to loosen. Arm 482 is attached to the body 490, and is configured for attachment to the rod 168 of the second piston assembly 160. Accordingly, the arm 482 may be formed with a hole 510 for receiving the rod 168. The hole may be threaded if desired.

Figure 11:
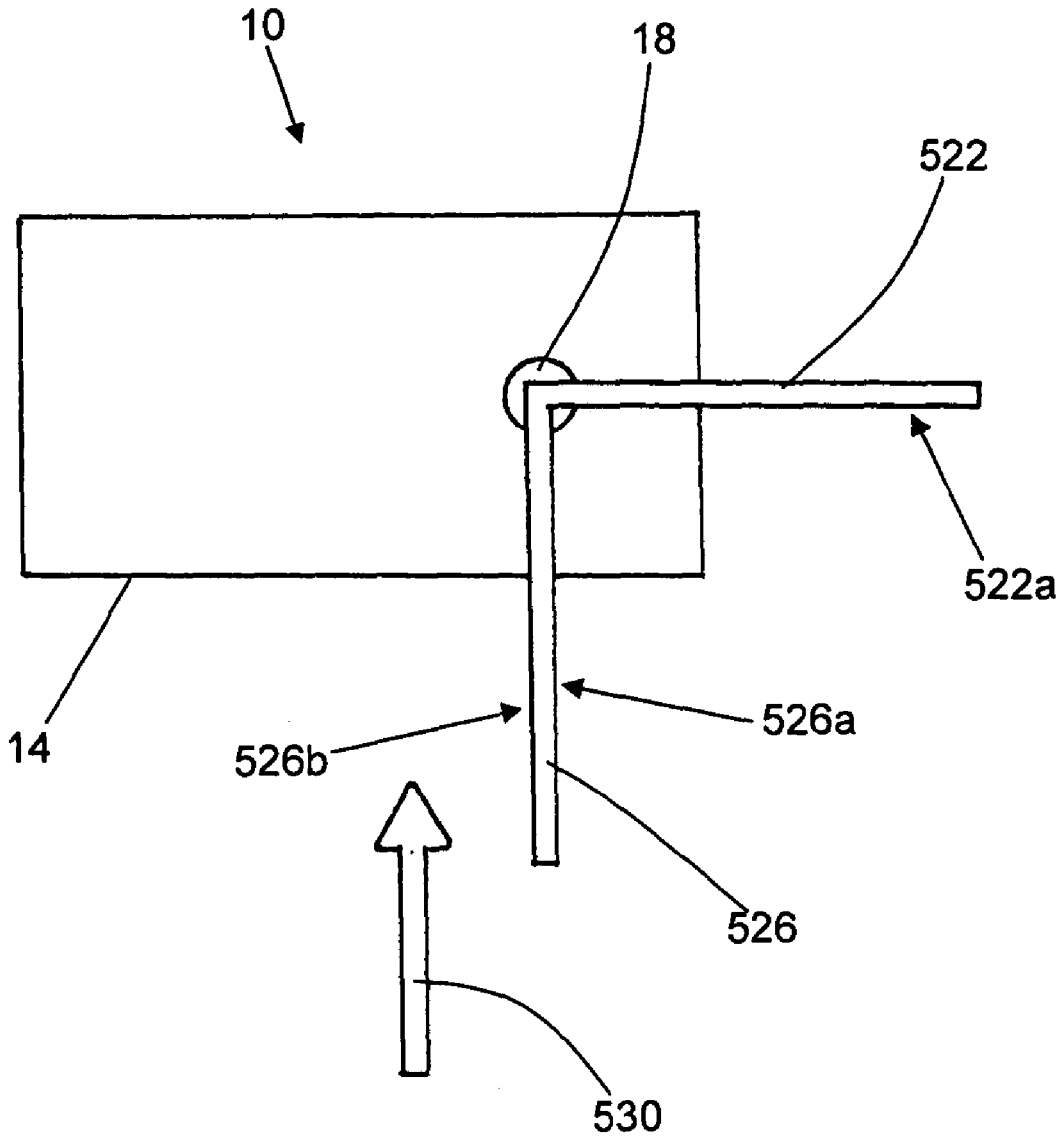
FIG. 11 shows a top view of an application of a multifunction actuator of one embodiment of the present invention.

Turning now to FIG. 11, a top view of a target actuator according to the present invention is shown. The actuator 10 is similar to those previously described. The shaft 18 is attached to a first target 522 and a second target 526. The targets 522, 526 are shown disposed perpendicular to each other, although any angle may be used. (While typically discussed in 90 degree increments, the actuator could be made to move the target in increments of any desired angle.) Arrow 530 indicates the line of fire, such as at a shooting range, such that a first face 522*a* of the first target 522 is presented to a shooter. If the actuator shaft 18 is rotated 90 degrees to the left, the first target 522 will not be presented to the shooter and a first face 526*a* of the second target 526 will be presented. Similarly, if the shaft 18 is rotated 90 degrees to the right from the position shown, the first target 522 is not presented to the shooter, and the second face 526*b* of the second target 526 is presented to the shooter.

Accordingly, the actuator 10 according to the present invention may be used to alternate between three different target faces which may be alternately presented to a shooter. The target actuator may thus be used to present a suspicious individual who, depending on the rotation of the actuator shaft 18 and targets, may become an armed individual threatening the shooter or who may become an innocent individual. The actuator could thus be used to present target training in which the shooter must make quick and accurate decisions regarding the target presented.

Turning now to FIG. 12, a front view of another target actuator according to the present invention is shown. The actuator 10 is oriented such that the shaft 18 is generally parallel to the ground 542. A bullet deflector plate 546 is placed in front of the actuator 10 so as to hide the actuator 10 from view as well as protect the actuator 10. The deflector 546 may be configured to resemble any item such as a car, box, dumpster, etc. A first target 550 and a second target 554 are attached to the shaft 18 such that in one of the actuator positions, the targets 550, 554 are disposed behind the bullet deflector plate 546.

In operation, the actuator shaft 18 may be rotated by 90 degrees to the right and to the left. If the shaft 18 is rotated to the left, target 550 would be presented to a shooter while target 554 remains hidden. If the target is rotated to the right, target 554 is presented to a shooter while target 550 remains hidden. Thus, either of the targets may be alternately presented to the shooter. The targets 550, 554 are made to resemble an armed assailant or an innocent person, requiring the shooter, such as a law enforcement officer, to quickly decide if the target presents a threat and take action. Alternately, the targets may be made to resemble animals for hunter training. One target may resemble an animal which is legal game, while the other target may resemble an animal which is not legal to hunt. Alternatively, both targets may represent animals which may be shot and the shooter must simply see and shoot an animal target which is presented before it is retracted.

Turning now to FIG. 13, a side view of another target actuator according to the present invention is shown. The actuator 10 is mounted such that the shaft 18 is generally parallel to the ground 562. The line of fire is shown by arrow 566. A bullet deflector plate 570 is disposed in front of the actuator 10. A first target 574 and a second target 578 are attached to the shaft 18 generally perpendicular to each other. The deflector plate 570 blocks the targets 574, 578 when in the position shown. The actuator 10 may be operated so as to rotate the shaft 18 counterclockwise. Thus, if the shaft 18 is rotated 90 degrees counterclockwise, the first target 574 is presented to a shooter. If the shaft is rotated 180 degrees counterclockwise from the position shown, the second target 578 is presented to a shooter. Thus, in the orientation shown, the actuator 10 may alternatively present the first target 574, second target 578, or no target to a shooter.

Turning now to FIG. 14, a front view of another target actuator according to the present invention is shown. The actuator 10 is disposed behind a bullet deflector plate 586, and oriented such that the axis of the shaft 18 is generally parallel to the ground 590. A target 594 is attached to the shaft 18 and oriented such that the target 594 is behind the deflector plate 586 in one of the actuator positions. The actuator 10 may be operated so as to rotate the shaft 18 and target 594 by about 90 degrees clockwise and counterclockwise. If the target 594 is rotated clockwise, it is moved into position 594*a*. Similarly, if the target 594 is rotated counterclockwise, it is moved into position 594*b*. Thus, the actuator 10 may be used to move a target from behind a deflector plate to either side of the deflector plate and into the line of fire.

It will be appreciated that many different target configurations and methods of actuation are possible with the present invention. Using a multifunction actuator according to the present invention, it is possible to actuate a target in many ways which challenge a shooter, including rotating a target to expose various different target faces, rotating a target so as to present different faces or not present the target, move target from behind obstacles, etc.

Figure 15:
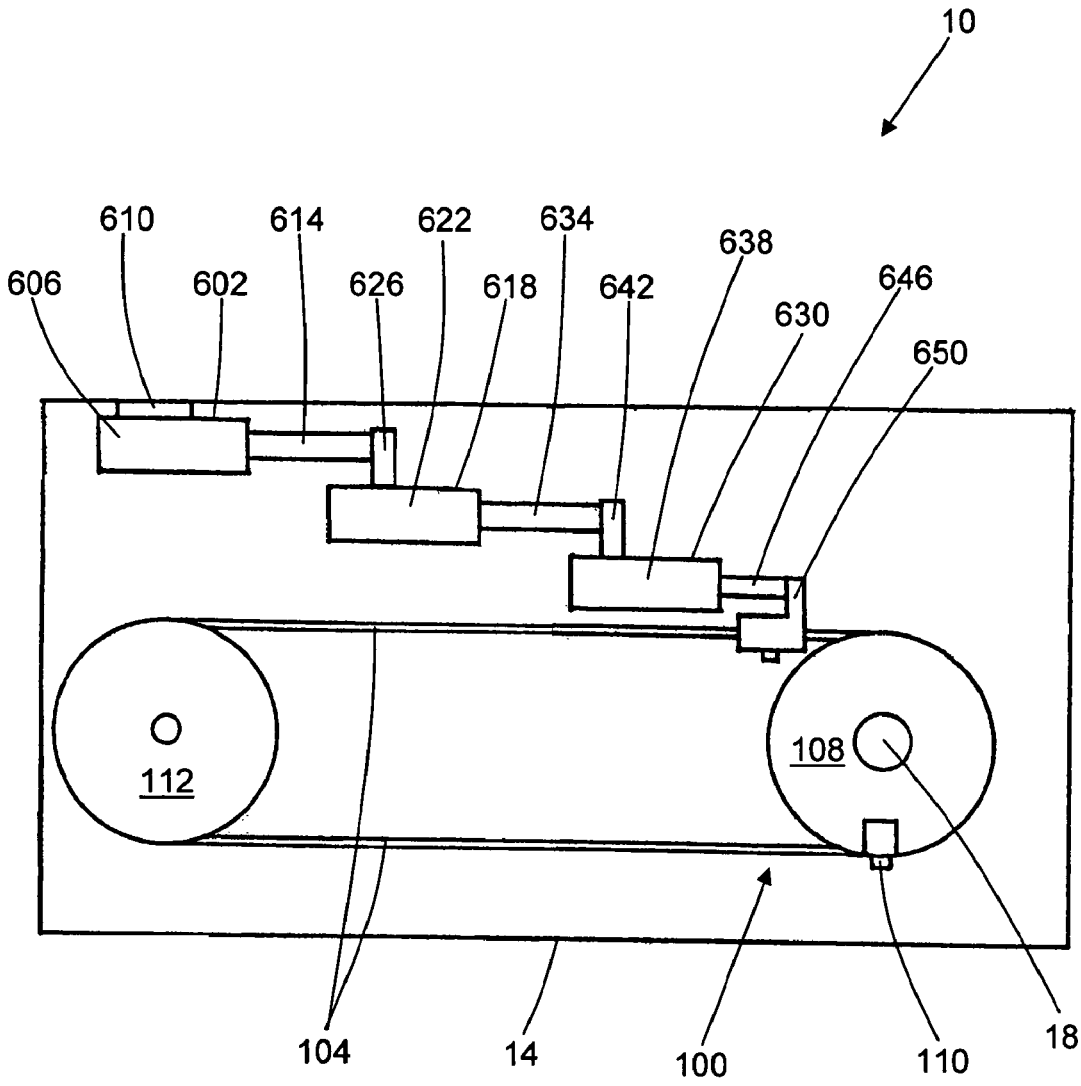
FIG. 15 shows a top view of a view of a multifunction actuator according to the present invention.

Turning now to FIG. 15, a top view of another actuator according to the present invention is shown. The actuator 10 is similar to that shown in FIG. 3 and operates in a similar manner. The actuator 10 includes a cable 104, first pulley 108, and second pulley 112. The first pulley 108 is connected to the drive shaft 18 which is used to rotate the targets which may be attached to the actuator 10. A first piston 602 is attached to the housing 14, typically attaching the first piston case 606 to the housing 14 by a bracket 610 or by a weld, bolt, etc. The first piston 606 is attached to a second piston 618, typically by attaching the first piston rod 614 to the second piston case 622 via a bracket 626. The second piston 618 is attached to a third piston 630, typically by attaching the second piston rod 634 to the third piston case 638 with a bracket 642. The third piston 630 is attached to the drive train 100, typically by attaching the third piston rod 646 to the drive train 100 via a bracket 650.

The drive train 100 may be a chain or gear drive as shown previously, or a cable 104 with a first pulley 108 and second pulley 112. The cable 104 may be attached to the first pulley 108 with a locking mechanism 110 such as a bolt or set screw.

The use of three pistons 602, 618, 630 allows for four or more target positions to be achieved, depending on the travel of pistons and resulting rotation of the drive shaft 18. If each of the pistons has sufficient travel to rotate the first pulley 108 and drive shaft 18 by 90 degrees, the drive shaft may be in a first position with all pistons retracted (0 degree rotation of the output shaft), a second position with one piston extended (90 degree rotation of the drive shaft), a third position with two pistons extended (180 degree rotation of the drive shaft), and a fourth position with all pistons extended (270 degree rotation of the drive shaft). Additionally, any piston extension and pulley diameter may be chosen to thereby select the desired amount of resulting rotation in the drive shaft and resulting movement of the target or targets attached to the actuator.

If the drive train 100 uses a chain and sprockets, the sprocket used in place of pulley 108 is affirmatively prevented from undesired rotation by the chain and sprocket teeth and may rotate through any angle without hindrance. If a cable 104 and pulley 108 are used as shown, the cable 104 may be wrapped around the pulley 108 multiple times to allow for unimpeded rotation of the pulley 108. It will be appreciated that if the cable 104 extends around only half of the pulley 108 and is attached to the pulley 108 (as at 110), only 180 degrees of rotation is possible. Conversely, if the cable 104 is attached to the first pulley 108 and is then wrapped completely around the pulley 108, more than a full turn of the pulley 108 is possible.

It will be appreciated that, in any of the various actuator designs shown, the linear actuators may be chosen according to the specific application. Linear actuator may be pneumatic pistons, hydraulic pistons, solenoids, etc. Pneumatic pistons are particularly suitable for many applications.

Thus there is disclosed an improved multifunction target actuator. Those skilled in the art will appreciate numerous modifications which can be made without departing from the scope and spirit of the present invention. The appended claims are intended to cover such modifications.

What is claimed is:

1. A method of operating a target actuator comprising:

selecting a target actuator configured for attachment to a target and having a first piston assembly and a second piston assembly, each of the first piston assembly and second piston assembly being actuatable so as to move a structure in the respective piston assembly between a first position and a second piston position;

attaching a target to the actuator;

selectively actuating one of the first and second piston assemblies to move the respective structure of that piston assembly from the first position to the second position to thereby rotate the target between a first target position and a second target position without moving the structure of the other piston assembly from the first position;

selectively actuating one of the first and second piston assemblies to thereby rotate the target between the first target position and a third target position.

2. The method of claim 1, wherein the piston assemblies comprise pneumatic piston assemblies and wherein the structure in each piston assembly comprises a piston, the method comprising moving the piston of the first piston assembly from the first position to the second position while maintaining the piston of the second piston assembly in the first position to turn the target between the first target position and the second target position, and further comprises moving the piston in the first piston assembly back into the first position and moving the piston in the second piston assembly into the second position to thereby move the target from the second target position to the third target position.

3. The method of claim 1, wherein the method further comprises actuating one of the first and second piston assemblies to thereby rotate the target from the second position back to the first position while maintaining the structure in the other assembly in either the first or second position.

4. The method of claim 3, wherein the method further comprises actuating the other of the first and second piston assemblies to thereby rotate the target from the second target position to the first target position.

5. The method according to claim 1, wherein the method comprises moving the target in increments of approximately 90 degrees.

6. The method according to claim 5, wherein the method comprises using a single piston and piston cylinder to move the target 90 degrees between the first and second position and using a single piston and cylinder to move the target 90 degrees between the first position and the third position.

7. The method according to claim 1, wherein at least one of the piston assemblies is attached to a drive gear, and wherein actuating one of the piston assemblies moves the piston assembly attached to the drive gear to thereby rotate a gear and a shaft supporting the target.

8. The method according to claim 1, wherein the piston assemblies are rotary pistons and wherein rotating one of the rotary pistons rotates the other piston assembly and a shaft connected to at least one of the piston assemblies.

9. The method according to claim 8, wherein each of the rotary pistons is configured to rotate approximately 90 degrees when actuatated.

10. A method of operating a target actuator comprising:

selecting a target actuator configured for attachment to a target and having a first piston assembly and a second piston assembly;

attaching a target to the actuator;

selectively actuating only one of the first and second piston assemblies to thereby rotate the target between a first target position and a second target position;

selectively actuating only one of the first and second piston assemblies to thereby rotate the target between the first target position and a third target position; and wherein the piston assemblies comprise a cylinder, piston, and rod connected to the piston, and wherein the first piston assembly rod is connected to the second piston assembly cylinder and the second rod is operatively connected to the target such that moving the first piston and rod moves the second piston assembly and thereby rotates the target.

11. The method of claim 10, wherein the method comprises moving the piston and rod of the first piston assembly in a direction and moving the piston and rod of the second piston assembly generally parallel to the piston and rod of the first piston assembly.

12. The method according to claim 10, wherein the method comprises selecting a target actuator in which the first piston assembly and the second piston assembly are operationally connected to a drive line and a pulley, such that actuation of the first piston assembly or the second piston assembly moves the drive line and rotates the pulley to thereby rotate the target.

13. The method according to claim 10, wherein the method comprises selecting a target actuator in which the first piston assembly and the second piston assembly are operationally connected to a gear such that actuation of the first assembly or the second piston assembly moves the gear and rotates the shaft to thereby rotate the target.

14. A method of operating a target actuator comprising:

selecting a target actuator configured for attachment to a target and having a first piston assembly and a second piston assembly;

attaching a target to the actuator;

selectively actuating one of the first and second piston assemblies to thereby rotate the target between a first target position and a second target position;

selectively actuating one of the first and second piston assemblies to thereby rotate the target between the first target position and a third target position; and wherein movement of the piston assemblies linearly moves a cable and thereby causes a pulley to rotate.

15. The method of claim 14, wherein the first piston assembly has a movable member which moves when the first piston assembly is actuated and the second piston assembly has a movable member which moves when the second piston assembly is actuated and wherein the movable members of the first piston assembly and second piston assembly move generally parallel to one another.

16. The method of claim 13, wherein the movable members of the first piston assembly and the second piston assembly comprise pistons and wherein the method comprises moving the pistons in directions generally parallel to one another.

17. The method of claim 13, wherein the movable members of the first piston assembly and the second piston assembly comprise vanes and wherein the method comprises moving the vanes in directions generally parallel to one another.

18. The method of claim 16, wherein the method comprises rotating the second piston assembly by actuation of the first piston assembly.

19. A method for rotating a target between a first position, a second position approximately 90 degrees from the first position, and a third position approximately 180 degrees from the second position, the method comprising:

selecting a target having a first side and a second side and attaching the target to a target actuator, which comprises a first piston assembly and a second piston assembly; and selectively actuating only one of the first piston assembly and the second piston assembly to move the target from the first position to the second position, and actuating both the first piston assembly and the second piston assembly to rotate the target from the second position to the third position.

20. The method according to claim 19, wherein the method further comprises actuating piston assemblies wherein the entire second piston assembly is moved by actuation of the first piston assembly generally parallel to the movement within the first piston assembly.

21. The method according to claim 20, wherein the method further comprises moving a drive line in response to movement of the second piston assembly, such that movement of the drive line causes rotational movement of the target.

22. The method according to claim 19, wherein the method comprises pneumatically actuating the first piston assembly and the second piston assembly.

23. A method for operating a target actuator comprising:

selecting a target actuator having a target attached thereto and having a first piston assembly and a second piston assembly; and wherein the method comprises disposing the target so as to be parallel with a line of fire of a shooter so that the target is in a first position and is not displayed for shooting to the shooter, and selectively actuating only one of the piston assemblies to turn the target 90 degrees in one direction to place the target in a second position and thereby show one face of the target to the shooter and selectively actuating both of the piston assemblies to turn the target 180 degrees in the other direction into a third position to thereby show an opposing face of the target to the shooter.

24. A method of operating a target actuator comprising:

selecting a target actuator configured for attachment to a target and having a first piston assembly and a second piston assembly;

attaching a target to the actuator;

selectively actuating one of the first and second piston assemblies to thereby rotate the target between a first target position and a second target position;

selectively actuating one of the first and second piston assemblies to thereby rotate the target between the first target position and a third target position;

wherein the method comprises disposing the target so as to be parallel with a line of fire of a shooter so that the target is in the first target position and is not displayed for shooting to the shooter, and selectively actuating one of the piston assemblies to turn the target 90 degrees in one direction to place the target in the second target position and thereby show one face of the target to the shooter and selectively actuating both of the piston assemblies to turn the target 90 degrees in the other direction from the first position into the third target position to thereby show an opposing face of the target to the shooter; and wherein the method comprises using a third piston assembly to rotate the target an additional ninety degrees from the second target position or the third position to thereby move the target into a fourth target position wherein the target is generally parallel to the shooter's line of fire.

25. A method of operating a target actuator comprising:

selecting a target actuator configured for attachment to a target and having a first piston assembly and a second piston assembly;

attaching a target to the target actuator;

selectively actuating one of the first and second piston assemblies to thereby rotate the target between a first target position and a second target position;

selectively actuating one of the first and second piston assemblies to thereby rotate the target between the first target position and a third target position; and wherein at least one of the piston assemblies is attached to a drive line, and wherein actuating one of the piston assemblies moves the piston assembly attached to the drive line to thereby move the drive line.

26. The method according to claim 25, wherein the drive line is wrapped around a pulley which turns a shaft to thereby turn the target.

27. The method of claim 25, wherein the first piston assembly and the second piston assembly each comprise a piston and wherein the method comprises actuating the second piston assembly so that its piston moves generally parallel to the movement of the piston of the first piston assembly.

28. The method of claim 25, wherein the first piston assembly and the second piston assembly each comprise a vane and wherein the method comprises actuating the second piston assembly so that its vane moves generally parallel to the movement of the vane of the first piston assembly.

29. The method according to claim 25, wherein the second piston assembly is attached to a moveable portion of the first piston assembly and to the drive line and the method comprises actuating the first piston assembly to move the second piston assembly and thereby move the drive line.

30. A method for actuating a target to be struck by a projectile, the method comprising:

disposing a target to be struck by a projectile in a first position generally parallel to a line of fire;

selectively actuating a first piston assembly and a second piston assembly to selectively rotate the target 90 degrees in one direction to show one side of the target, and 90 degrees in the opposite direction to expose an opposing side of the target, wherein actuating only the first piston assembly rotates the target 90 degrees in one direction and actuating only the second piston assembly rotates the target 90 degrees in the opposite direction.

31. The method according to claim 30, wherein the first piston assembly has a movable member disposed therein and the second piston assembly has a movable member therein and wherein the method comprises moving the moveable members of the first piston assembly and the second piston assembly in generally parallel paths to turn the target 90 degrees in either direction.

32. The method according to claim 31, wherein the method comprises using a first piston assembly having a cylinder and a piston disposed therein which acts as the movable member of the first piston assembly and the second piston assembly having a cylinder and a piston disposed therein which acts as the movable member of the second piston assembly.

33. The method according to claim 32, wherein the method comprises moving the piston of the first piston assembly between first and second positions and moving the piston of the second piston assembly between first and second positions generally parallel to the movement of the piston of the first piston assembly.

34. The method according to claim 31, wherein the method comprises using a first piston assembly forming a rotary piston and including a vane which acts as the movable member of the first piston assembly and a second rotary piston forming a rotary piston and having a vane which acts as the movable member of the second piston assembly.

35. The method according to claim 34, wherein the method comprises moving the vane of the first piston assembly between first and second positions and moving the vane of the second piston assembly between first and second positions generally parallel to the movement of the vane of the first piston assembly.

36. A method for selectively actuating a target so as to move the target between a plurality of positions, the method comprising:

selecting a target actuator having a target attached thereto and disposed in a first target position;

actuating a first piston assembly of the target actuator to move the target from the first position to a second position by moving a member in the first piston assembly from the first target position to a second target position, and actuating a second piston assembly to move the target from the first position to a third position or from the second position to the first position by moving a member in the second piston assembly in a direction generally parallel to the movement of the member of the first piston assembly.

37. The method according to claim 36, wherein the first piston assembly is actuated to move the target back from the second target position to the first target position and wherein the second piston assembly is actuated to move the target from the first target position to the second target position.

38. The method according to claim 36, wherein the second piston assembly is actuated to move the target from the second target position to the first target position, and wherein the first piston assembly is actuated to move the second piston assembly and thereby move the target from the first target position to the third target position.

* * * * *